US010701511B2

(12) United States Patent
Lee et al.

(10) Patent No.: US 10,701,511 B2
(45) **Date of Patent: *Jun. 30, 2020**

(54) METHOD FOR GENERATING FILTER FOR AUDIO SIGNAL, AND PARAMETERIZATION DEVICE FOR SAME

(71) Applicant: WILUS INSTITUTE OF STANDARDS AND TECHNOLOGY INC., Gyeonggi-do (KR)

(72) Inventors: Taegyu Lee, Gyeonggi-do (KR); Hyunoh Oh, Gyeonggi-do (KR)

(73) Assignee: WILUS INSTITUTE OF STANDARDS AND TECHNOLOGY INC., Gyeonggi-Do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/544,832

(22) Filed: Aug. 19, 2019

(65) Prior Publication Data

US 2019/0373399 A1 Dec. 5, 2019

Related U.S. Application Data

(63) Continuation of application No. 16/178,581, filed on Nov. 1, 2018, now Pat. No. 10,433,099, which is a (Continued)

(30) Foreign Application Priority Data

Dec. 23, 2013 (KR) ..... 10-2013-0161114

(51) Int. Cl.
*H04S 7/00* (2006.01)
*G10L 19/008* (2013.01)

(Continued)

(52) U.S. Cl.
CPC ..... *H04S 7/307* (2013.01); *G10L 19/008* (2013.01); *G10L 19/0204* (2013.01); *H04S 3/008* (2013.01);

(Continued)

(58) Field of Classification Search
USPC ..... 381/1, 17, 18, 23, 61, 63, 306, 307, 309
See application file for complete search history.

(56) References Cited

U.S. PATENT DOCUMENTS 5,329,587 A 7/1994 Morgan et al.
5,371,799 A 12/1994 Lowe et al.

(Continued)

FOREIGN PATENT DOCUMENTS

EP 0 700 155 3/1996
EP 2 530 840 12/2012

(Continued)

OTHER PUBLICATIONS

International Preliminary Report on Patentability (Chapter I) for PCT/KR2014/008677 dated Mar. 31, 2016 and its English translation from WIPO.

(Continued)

*Primary Examiner* — Yosef K Laekemariam
(74) *Attorney, Agent, or Firm* — Ladas & Parry, LLP

(57) ABSTRACT

The present invention relates to a method for generating a filter for an audio signal and a parameterization device for the same, and more particularly, to a method for generating a filter for an audio signal, to implement filtering of an input audio signal with a low computational complexity, and a parameterization device therefor.

To this end, provided are a method for generating a filter for an audio signal, including: receiving at least one binaural room impulse response (BRIR) filter coefficients for binaural filtering of an input audio signal; converting the BRIR (Continued)

200A filter coefficients into a plurality of subband filter coefficients; obtaining average reverberation time information of a corresponding subband by using reverberation time information extracted from the subband filter coefficients; obtaining at least one coefficient for curve fitting of the obtained average reverberation time information; obtaining flag information indicating whether the length of the BRIR filter coefficients in a time domain is more than a predetermined value; obtaining filter order information for determining a truncation length of the subband filter coefficients, the filter order information being obtained by using the average reverberation time information or the at least one coefficient according to the obtained flag information and the filter order information of at least one subband being different from filter order information of another subband; and truncating the subband filter coefficient by using the obtained filter order information and a parameterization device therefor.

18 Claims, 19 Drawing Sheets

Related U.S. Application Data continuation of application No. 15/789,960, filed on Oct. 21, 2017, now Pat. No. 10,158,965, which is a continuation of application No. 15/107,462, filed as application No. PCT/KR2014/012758 on Dec. 23, 2014, now Pat. No. 9,832,589.

(51) Int. Cl.
*H04S 3/00* (2006.01)
*G10L 19/02* (2013.01)

(52) U.S. Cl.
CPC ..... *H04S 7/305* (2013.01); *H04S 2400/01* (2013.01); *H04S 2400/03* (2013.01); *H04S 2420/01* (2013.01); *H04S 2420/03* (2013.01); *H04S 2420/07* (2013.01)

(56) References Cited

U.S. PATENT DOCUMENTS

| | | | | |
|---|---|---|---|---|
| 5,544,249 | A | 8/1996 | Opitz | |
| 5,757,931 | A | 5/1998 | Yamada et al. | |
| 6,108,626 | A | 8/2000 | Cellario et al. | |
| 7,715,575 | B1 | 5/2010 | Sakurai et al. | |
| 8,265,284 | B2 | 9/2012 | Villemoes et al. | |
| 8,515,104 | B2 * | 8/2013 | Dickins | H04S 7/306 381/309 |
| 8,788,554 | B2 | 7/2014 | Christoph | |
| 9,319,794 | B2 | 4/2016 | Betlehem et al. | |
| 9,432,790 | B2 | 8/2016 | Raghuvanshi et al. | |
| 9,578,437 | B2 | 2/2017 | Oh et al. | |
| 9,832,585 | B2 | 11/2017 | Oh et al. | |
| 2005/0117762 | A1 | 6/2005 | Sakurai et al. | |
| 2007/0071249 | A1 | 3/2007 | Reining et al. | |
| 2007/0100612 | A1 | 5/2007 | Ekstrand et al. | |
| 2007/0172086 | A1 | 7/2007 | Dickins et al. | |
| 2008/0008342 | A1 | 1/2008 | Sauk | |
| 2008/0025519 | A1 | 1/2008 | Yu et al. | |
| 2008/0033730 | A1 | 2/2008 | Jot et al. | |
| 2008/0192941 | A1 | 8/2008 | Oh et al. | |
| 2008/0205658 | A1 * | 8/2008 | Breebaart | H04S 3/004 381/17 |
| 2008/0253578 | A1 | 10/2008 | Breebaart et al. | |
| 2009/0012638 | A1 | 1/2009 | Lou | |
| 2009/0041263 | A1 | 2/2009 | Hoshuyama | |
| 2009/0043591 | A1 | 2/2009 | Breebaart et al. | |
| 2009/0103738 | A1 | 4/2009 | Faure et al. | |
| 2009/0252356 | A1 | 10/2009 | Goodwin et al. | |
| 2009/0319283 | A1 | 12/2009 | Schnell et al. | |
| 2010/0017195 | A1 | 1/2010 | Villemoes | |
| 2010/0080112 | A1 | 4/2010 | Bertrand et al. | |
| 2010/0169104 | A1 | 7/2010 | Ekstrand et al. | |
| 2010/0246832 | A1 | 9/2010 | Villemoes et al. | |
| 2010/0246851 | A1 | 9/2010 | Buck et al. | |
| 2010/0322431 | A1 | 12/2010 | Lokki et al. | |
| 2011/0170721 | A1 | 7/2011 | Dickins et al. | |
| 2011/0211702 | A1 | 9/2011 | Mundt et al. | |
| 2011/0261948 | A1 | 10/2011 | Deng et al. | |
| 2011/0264456 | A1 | 10/2011 | Koppens et al. | |
| 2011/0305345 | A1 | 12/2011 | Bouchard et al. | |
| 2012/0014528 | A1 | 1/2012 | Wang | |
| 2012/0039477 | A1 | 2/2012 | Schijers et al. | |
| 2012/0243713 | A1 | 9/2012 | Hess | |
| 2013/0028427 | A1 | 1/2013 | Yamamoto et al. | |
| 2013/0090933 | A1 | 4/2013 | Villemoes et al. | |
| 2013/0182870 | A1 | 7/2013 | Villemoes | |
| 2013/0208902 | A1 | 8/2013 | Yamamoto et al. | |
| 2013/0272526 | A1 | 10/2013 | Walther | |
| 2013/0272527 | A1 | 10/2013 | Oomen et al. | |
| 2014/0006037 | A1 | 1/2014 | Honma et al. | |
| 2014/0088978 | A1 | 3/2014 | Mundt et al. | |
| 2014/0355796 | A1 | 12/2014 | Xiang et al. | |
| 2015/0030160 | A1 | 1/2015 | Lee et al. | |
| 2015/0223002 | A1 | 8/2015 | Mehta et al. | |
| 2016/0189723 | A1 | 6/2016 | Davis | |
| 2016/0198281 | A1 | 7/2016 | Oh et al. | |
| 2016/0219388 | A1 | 7/2016 | Oh et al. | |
| 2016/0249149 | A1 | 8/2016 | Oh et al. | |
| 2016/0275956 | A1 | 9/2016 | Lee et al. | |
| 2016/0277865 | A1 | 9/2016 | Lee et al. | |
| 2016/0323688 | A1 | 11/2016 | Lee et al. | |
| 2018/0048975 | A1 | 2/2018 | Oh et al. | |
| 2018/0048981 | A1 | 2/2018 | Lee et al. | |
| 2019/0082285 | A1 | 3/2019 | Lee et al. | |

FOREIGN PATENT DOCUMENTS

| | | |
|---|---|---|
| EP | 2 541 542 | 1/2013 |
| EP | 2 840 811 | 2/2015 |
| EP | 3 048 814 | 7/2016 |
| JP | 2009-531906 | 9/2009 |
| JP | 2009-261022 | 11/2009 |
| JP | 5084264 | 11/2012 |
| KR | 10-2005-0123396 | 12/2005 |
| KR | 10-0754220 | 9/2007 |
| KR | 10-2008-0076691 | 8/2008 |
| KR | 10-2008-0078882 | 8/2008 |
| KR | 10-2008-0098307 | 11/2008 |
| KR | 10-2008-0107422 | 12/2008 |
| KR | 10-2009-0020813 | 2/2009 |
| KR | 10-2009-0047341 | 5/2009 |
| KR | 10-0924576 | 11/2009 |
| KR | 10-2010-0062784 | 6/2010 |
| KR | 10-2010-0063113 | 6/2010 |
| KR | 10-0971700 | 7/2010 |
| KR | 10-2011-0002491 | 1/2011 |
| KR | 10-2012-0006060 | 1/2012 |
| KR | 10-2012-0013893 | 2/2012 |
| KR | 10-1146841 | 5/2012 |
| KR | 10-2013-0045414 | 5/2013 |
| KR | 10-2013-0081290 | 7/2013 |
| KR | 10-1304797 | 9/2013 |
| WO | 2008/003467 | 1/2008 |
| WO | 2009/046223 | 4/2009 |
| WO | 2011/115430 | 9/2011 |
| WO | 2012/023864 | 2/2012 |
| WO | 2015/041476 | 3/2014 |
| WO | 2015/099424 | 7/2015 |

OTHER PUBLICATIONS

Written Opinion of the International Searching Authority for PCT/KR2014/008677 dated Jan. 23, 2015 and its English translation from WIPO.

(56) References Cited

OTHER PUBLICATIONS

International Search Report for PCT/KR2014/008677 dated Jan. 23, 2015 and its English translation from WIPO.
International Preliminary Report on Patentability (Chapter I) for PCT/KR2014/008678 dated Mar. 31, 2016 and its English translation from WIPO.
Written Opinion of the International Searching Authority for PCT/KR2014/008678 dated Jan. 23, 2015 and its English translation from WIPO.
International Search Report for PCT/KR2014/008678 dated Jan. 23, 2015 and its English translation from WIPO.
International Preliminary Report on Patentability (Chapter I) for PCT/KR2014/008679 dated Mar. 31, 2016 and its English translation from WIPO.
Written Opinion of the International Searching Authority for PCT/KR2014/008679 dated Jan. 26, 2015 and its English translation from WIPO.
International Search Report for PCT/KR2014/008679 dated Jan. 26, 2015 and its English translation from WIPO.
International Preliminary Report on Patentability (Chapter I) for PCT/KR2014/009975 dated May 6, 2016 and its English translation from WIPO.
Written Opinion of the International Searching Authority for PCT/KR2014/009975 dated Jan. 26, 2015 and its English translation from WIPO.
International Search Report for PCT/KR2014/009975 dated Jan. 26, 2015 and its English translation from WIPO.
International Preliminary Report on Patentability (Chapter I) for PCT/KR2014/009978 dated May 6, 2016 and its English translation from WIPO.
Written Opinion of the International Searching Authority for PCT/KR2014/009978 dated Jan. 20, 2015 and its English translation from WIPO.
International Search Report for PCT/KR2014/009978 dated Jan. 20, 2015 and its English translation from WIPO.
International Preliminary Report on Patentability (Chapter I) for PCT/KR2014/012758 dated Jul. 7, 2016 and its English translation from WIPO.
International Preliminary Report on Patentability (Chapter I) for PCT/KR2014/012764 dated Jul. 7, 2016 and its English translation from WIPO.
Written Opinion of the International Searching Authority for PCT/KR2014/012764 dated Apr. 13, 2015 and its English translation from WIPO.
International Search Report for PCT/KR2014/012764 dated Apr. 13, 2015 and its English translation from WIPO.
International Preliminary Report on Patentability (Chapter I) for PCT/KR2014/012766 dated Jul. 7, 2016 and its English translation from WIPO.
Written Opinion of the International Searching Authority for PCT/KR2014/012766 dated Apr. 13, 2015 and its English translation from WIPO.
International Search Report for PCT/KR2014/012766 dated Apr. 13, 2015 and its English translation from WIPO.
Written Opinion of the International Searching Authority for PCT/KR2015/002669 dated Jun. 5, 2015 and its English translation provided by Applicant's foreign counsel.
International Search Report for PCT/KR2015/002669 dated Jun. 5, 2015 and its English translation from WIPO.
Written Opinion of the International Searching Authority for PCT/KR2015/003328 dated Jun. 22, 2015 and its English translation provided by Applicant's foreign counsel.
International Search Report for PCT/KR2015/003328 dated Jun. 22, 2015 and its English translation from WIPO.
Written Opinion of the International Searching Authority for PCT/KR2015/003330 dated Jun. 5, 2015 and its English translation provided by Applicant's foreign counsel.
International Search Report for PCT/KR2015/003330 dated Jun. 5, 2015 and its English translation from WIPO.
Astik Biswas et al., "Admissible wavelet packet features based on human inner ear frequency response for Hindi consonant recognition", Computers & Electrical Engineering, Feb. 22, 2014, p. 1111-1122.
Office Action dated Apr. 6, 2016 for Korean Patent Application No. 10-2016-7001431 and its English translation provided by Applicant's foreign counsel.
Office Action dated Apr. 12, 2016 for Korean Patent Application No. 10-2016-7001432 and its English translation provided by Applicant's foreign counsel.
Non-Final Office Action dated Jun. 13, 2016 for U.S. Appl. No. 14/990,814 (now published as U.S. 2016/0198281).
Non-Final Office Action dated Jun. 13, 2016 for U.S. Appl. No. 15/145,822 (now issued as U.S. Pat. No. 9,584,943).
Notice of Allowance dated Jul. 19, 2017 for U.S. Appl. No. 15/107,462 (now published as U.S. 2016/0323688).
Non-Final Office Action dated Mar. 16, 2017 for U.S. Appl. No. 15/107,462 (now published as U.S. 2016/0323688).
Notice of Allowance dated Aug. 28, 2017 for U.S. Appl. No. 15/300,277 (now published as U.S. 2017/0188175).
Extended European Search Report dated Sep. 15, 2017 for EP Patent Application No. 15764805.6.
Final Office Action dated Aug. 23, 2017 for U.S. Appl. No. 15/022,922 (now published as U.S. 2016/0234620).
Office Action dated Jun. 5, 2017 for Korean Patent Application No. 10-2016-7016590 and its English translation provided by Applicant's foreign council.
Extended European Search Report dated Jun. 1, 2017 for European Patent Application No. 14856742.3.
Extended European Search Report dated Jun. 1, 2017 for European Patent Application No. 14855415.7.
Extended European Search Report dated Jul. 27, 2017 for European Patent Application No. 14875534.1.
"Information technology—MPEG audio technologies—part 1: MPEG Surround", ISO/IEC 23003-1:2007, IEC, 3, Rue De Varembe, PO Box 131, CH-1211 Geneva 20, Switzerland, Jan. 29, 2007 (Jan. 29, 2007), pp. 1-280, XPO82000863, pp. 245, 249.
David Virette et al.: "Description of France Telecom Binaural Decoding proposal for MPEG Surround", 76, MPEG Meeting, Mar. 4, 2006-Jul. 4, 2006; Montreux; (Motion Picture Expert Group or ISO/IEC JTC1/SC29/WG11), No. M13276, 30.
Torres J C B et al.: "Low-order modeling of head-related transfer functions using wavelet transforms", Proceedings/2004 IEEE International Symposium on Circuits and Systems: May 23-26, 2004, Sheraton Vancouver Wall.
ISO/IEC FDIS 23003-1:2006(E). Information technology—MPEG audio technologies Part 1: MPEG Surround. ISO/IEC JTC 1/SC 29/WG 11. Jul. 21, 2006, pp. i-283.
Emerit Marc et al: "Efficient Binaural Filtering in QMF Domain for BRIR", AES Convention 122; May 2007, AES, 60 East 42$^{nd}$ Street, Room 2520, New York 10165-2520, USA, May 1, 2007 (May 1, 2007), XP040508167 *the whole document*.
Smith, Julious Orion. "Physical Audio Signal Processing: for virtual musical instruments and audio effects." pp. 1-3, 2006.
Office Action dated Mar. 20, 2017 for Korean Patent Application No. 10-2016-7006858 and its English translation provided by Applicant's foreign counsel.
Office Action dated Mar. 20, 2017 for Korean Patent Application No. 10-2016-7006859 and its English translation provided by Applicant's foreign counsel.
Office Action dated Mar. 20, 2017 for Korean Patent Application No. 10-2016-7009852 and its English translation provided by Applicant's foreign counsel.
Office Action dated Mar. 20, 2017 for Korean Patent Application No. 10-2016-7009853 and its English translation provided by Applicant's foreign counsel.
Non-Final Office Action dated Mar. 22, 2017 for U.S. Appl. No. 15/022,923 (now published as U.S. 2016/0219388).
Non-Final Office Action dated Feb. 21, 2017 for U.S. Appl. No. 15/022,922 (now published as U.S. 2016/0234620).
Extended European Search Report dated Apr. 28, 2017 for European Patent Application No. 14846160.1.

(56) References Cited

OTHER PUBLICATIONS

Extended European Search Report dated Apr. 28, 2017 for European Patent Application No. 14845972.0.
Extended European Search Report dated Apr. 28, 2017 for European Patent Application No. 14846500.8.
Jeroen Breebaart et al., "Binaural Rendering in MPEG Surround", EURASIP Journal on advances in signal processing, Jan. 2, 2008, vol. 2008, No. 7, pp. 1-14.
International Search Report for PCT/KR2014/012758 dated Apr. 13, 2015 and its English translation from WIPO (now published as WO 2015/099424).
Written Opinion of the International Searching Authority for PCT/KR2014/012758 dated Apr. 10, 2015 and its English translation from WIPO (now published as WO 2015/099424).
Non-Final Office Action dated Apr. 5, 2018 for U.S. Appl. No. 15/031,275 (now published as U.S. 2016/0277865).
Non-Final Office Action dated Jun. 15, 2018 for U.S. Appl. No. 15/022,923 (now published as U.S. 2016/0219388).
Advisory Office Action dated Apr. 25, 2018 for U.S. Appl. No. 15/022,923 (now published as U.S. 2016/0219388).
Notice of Allowance dated May 3, 2018 for U.S. Appl. No. 15/795,180 (now published as U.S. 2018/0048975).
Final Office Action dated May 7, 2018 for U.S. Appl. No. 15/031,274 (now published as U.S. 2016/0275956).
Notice of Allowance dated May 9, 2018 for Chinese Application No. 201580018973.0 and its English translation provided by Applicant's foreign council.
Office Action dated Jun. 15, 2018 for Canadian Application No. 2,934,856.
Notice of Allowance dated Aug. 3, 2018 for U.S. Appl. No. 15/789,960 (now published as U.S. 2018/0048981).
Non-Final Office Action dated Jan. 30, 2018 for U.S. Appl. No. 15/789,960 (now published as U.S. 2018/0048981).
Non-Final Office Action dated Jan. 24, 2019 for U.S. Appl. No. 15/942,588.
Final Office Action dated Feb. 7, 2019 for U.S. Appl. No. 15/022,923.
Office Action dated Jan. 16, 2019 for Canadian Patent Application No. 2,924,458.
Office Action dated Feb. 7, 2019 for European Patent Application No. 14 855 415.7.
Notice of Allowance dated Feb. 8, 2019 for European Patent Application No. 14 856 742.3.
Notice of Allowance dated May 20, 2019 for U.S. Appl. No. 16/178,581 (now published as U.S. 2019/0082285).
Office Action dated Dec. 14, 2018 for U.S. Appl. No. 16/178,581 (now published as U.S. 2019/0082285).
Office Action dated Feb. 18, 2020 for European Patent Application No. 15764805.6.
Jeongil SEO et al.: "Technical Description of ETRI/Yonsei/WILUS Binaural CE Proposal in MPEG-H 3D Audio", 107. MPEG Meeting; Jan. 13, 2014-Jan. 17, 2014; San Jose (Motion Picture Group or ISO/IEC JTC1/SC29/WG11), No. m32223, Jan. 8, 2014 (Jan. 8, 2014), XP030060675.
Marc Emerit et al.: "Thoughts on Binaural Decoder Parameterization", 106. MPEG Meeting: Oct. 28, 2013-Nov. 1, 2013; Geneva; Motion Picture Expert Group or ISO/IEC JTCI/SC29/WG11). No. m31427, Oct. 23, 2013 (Oct. 23, 2013), XP030059879.
Preliminary Office Action dated Mar. 9, 2020 for Brazilian Application No. BR112016005956-5 and its English translation provided by Applicant's foreign counsel.
Preliminary Office Action dated Mar. 31, 2020 for Brazilian Application No. BR112016014892-4 and its English translation provided by Applicant's foreign counsel.

* cited by examiner

METHOD FOR GENERATING FILTER FOR AUDIO SIGNAL, AND PARAMETERIZATION DEVICE FOR SAME

CROSS-REFERENCE TO RELATED APPLICATIONS

This application claims priority to and the benefit of Korean Patent Application No. 10-2013-0161114 filed in the Korean Intellectual Property Office on Dec. 23, 2013, the entire contents of which are incorporated herein by reference.

TECHNICAL FIELD

The present invention relates to a method for generating a filter for an audio signal and a parameterization device for the same, and more particularly, to a method for generating a filter for an audio signal, to implement filtering of an input audio signal with a low computational complexity, and a parameterization device therefor.

BACKGROUND ART

There is a problem in that binaural rendering for hearing multi-channel signals in stereo requires a high computational complexity as the length of a target filter increases. In particular, when a binaural room impulse response (BRIR) filter reflected with characteristics of a recording room is used, the length of the BRIR filter may reach 48,000 to 96,000 samples. Herein, when the number of input channels increases like a 22.2 channel format, the computational complexity is enormous.

When an input signal of an i-th channel is represented by $x_i(n)$, left and right BRIR filters of the corresponding channel are represented by $b_i^L(n)$ and $b_i^R(n)$, respectively, and output signals are represented by $y^L(n)$ and $y^R(n)$, binaural filtering can be expressed by an equation given below.

$$y^m(n) = \sum_i x_i(n) * b_i^m(n) \quad \text{[Equation 1]}$$

Herein, m is L or R, and * represents a convolution. The above time-domain convolution is generally performed by using a fast convolution based on Fast Fourier transform (FFT). When the binaural rendering is performed by using the fast convolution, the FFT needs to be performed by the number of times corresponding to the number of input channels, and inverse FFT needs to be performed by the number of times corresponding to the number of output channels. Moreover, since a delay needs to be considered under a real-time reproduction environment like multi-channel audio codec, block-wise fast convolution needs to be performed, and more computational complexity may be consumed than a case in which the fast convolution is just performed with respect to a total length.

However, most coding schemes are achieved in a frequency domain, and in some coding schemes (e.g., HE-AAC, USAC, and the like), a last step of a decoding process is performed in a QMF domain. Accordingly, when the binaural filtering is performed in the time domain as shown in Equation 1 given above, an operation for QMF synthesis is additionally required as many as the number of channels, which is very inefficient. Therefore, it is advantageous that the binaural rendering is directly performed in the QMF domain.

DISCLOSURE

Technical Problem

The present invention has an object, with regard to reproduce multi-channel or multi-object signals in stereo, to implement filtering process, which requires a high computational complexity, of binaural rendering for reserving immersive perception of original signals with very low complexity while minimizing the loss of sound quality.

Furthermore, the present invention has an object to minimize the spread of distortion by using high-quality filter when a distortion is contained in the input signal.

Furthermore, the present invention has an object to implement finite impulse response (FIR) filter which has a long length with a filter which has a shorter length.

Furthermore, the present invention has an object to minimize distortions of portions destructed by discarded filter coefficients, when performing the filtering by using truncated FIR filter.

Technical Solution

In order to achieve the objects, the present invention provides a method and an apparatus for processing an audio signal as below.

An exemplary embodiment of the present invention provides a method for generating a filter for an audio signal, including: receiving at least one binaural room impulse response (BRIR) filter coefficients for binaural filtering of an input audio signal; converting the BRIR filter coefficients into a plurality of subband filter coefficients; obtaining average reverberation time information of a corresponding subband by using reverberation time information extracted from the subband filter coefficients; obtaining at least one coefficient for curve fitting of the obtained average reverberation time information; obtaining flag information indicating whether the length of the BRIR filter coefficients in a time domain is more than a predetermined value; obtaining filter order information for determining a truncation length of the subband filter coefficients, the filter order information being obtained by using the average reverberation time information or the at least one coefficient according to the obtained flag information and the filter order information of at least one subband being different from filter order information of another subband; and truncating the subband filter coefficients by using the obtained filter order information.

An exemplary embodiment of the present invention provides a parameterization device for generating a filter for an audio signal, wherein: the parameterization device receives at least one binaural room impulse response (BRIR) filter coefficients for binaural filtering of an input audio signal; converts the BRIR filter coefficients into a plurality of subband filter coefficients; obtains average reverberation time information of a corresponding subband by using reverberation time information extracted from the subband filter coefficients; obtains at least one coefficient for curve fitting of the obtained average reverberation time information; obtains flag information indicating whether the length of the BRIR filter coefficients in a time domain is more than a predetermined value; obtains filter order information for determining a truncation length of the subband filter coefficients, the filter order information being obtained by using the average reverberation time information or the at least one coefficient according to the obtained flag information and the filter order information of at least one subband being different from filter order information of another subband; and truncates the subband filter coefficients by using the obtained filter order information.

According to the exemplary embodiment of the present invention, when the flag information indicates that the length of the BRIR filter coefficients is more than a predetermined value, the filter order information may be determined based on a curve-fitted value by using the obtained at least one coefficient.

In this case, the curve-fitted filter order information may be determined as a value of power of 2 using an approximated integer value in which a polynomial curve-fitting is performed by using the at least one coefficient as an index.

Further, according to the exemplary embodiment of the present invention, when the flag information indicates that the length of the BRIR filter coefficients is not more than the predetermined value, the filter order information may be determined based on the average reverberation time information of the corresponding subband without performing the curve fitting.

Herein, the filter order information may be determined as a value of power of 2 using a log-scaled approximated integer value of the average reverberation time information as an index.

Further, the filter order information may be determined as a smaller value of a reference truncation length of the corresponding subband determined based on the average reverberation time information and an original length of the subband filter coefficients.

In addition, the reference truncation length may be a value of power of 2.

Further, the filter order information may have a single value for each subband.

According to the exemplary embodiment of the present invention, the average reverberation time information may be an average value of reverberation time information of each channel extracted from at least one subband filter coefficients of the same subband.

Another exemplary embodiment of the present invention provides a method for processing an audio signal, including: receiving an input audio signal; receiving at least one binaural room impulse response (BRIR) filter coefficients for binaural filtering of the input audio signal; converting the BRIR filter coefficients into a plurality of subband filter coefficients; obtaining flag information indicating whether the length of the BRIR filter coefficients in a time domain is more than a predetermined value; truncating each subband filter coefficients based on filter order information obtained by at least partially using characteristic information extracted from the corresponding subband filter coefficients, the truncated subband filter coefficients being filter coefficients of which energy compensation is performed based on the flag information and the length of at least one truncated subband filter coefficients being different from the length of the truncated subband filter coefficients of another subband; and filtering each subband signal of the input audio signal by using the truncated subband filter coefficients.

Another exemplary embodiment of the present invention provides an apparatus for processing an audio signal for binaural rendering for an input audio signal, including: a parameterization unit generating a filter for the input audio signal; and a binaural rendering unit receiving the input audio signal and filtering the input audio signal by using parameters generated by the parameterization unit, wherein the parameterization unit receives at least one binaural room impulse response (BRIR) filter coefficients for binaural filtering of the input audio signal; converts the BRIR filter coefficients into a plurality of subband filter coefficients; obtains flag information indicating whether the length of the BRIR filter coefficients in a time domain is more than a predetermined value; truncates each subband filter coefficients based on filter order information obtained by at least partially using characteristic information extracted from the corresponding subband filter coefficients, the truncated subband filter coefficients being filter coefficients of which energy compensation is performed based on the flag information and the length of at least one truncated subband filter coefficients being different from the length of the truncated subband filter coefficients of another subband; and the binaural rendering unit filters each subband signal of the input audio signal by using the truncated subband filter coefficients.

Another exemplary embodiment of the present invention provides a parameterization device for generating a filter for an audio signal, wherein: the parameterization device receives at least one binaural room impulse response (BRIR) filter coefficients for binaural filtering of an input audio signal; converts the BRIR filter coefficients into a plurality of subband filter coefficients; obtains flag information indicating whether the length of the BRIR filter coefficients in a time domain is more than a predetermined value; and truncates each subband filter coefficients based on filter order information obtained by at least partially using characteristic information extracted from the corresponding subband filter coefficients, the truncated subband filter coefficients being filter coefficients of which energy compensation is performed based on the flag information and the length of at least one truncated subband filter coefficients being different from the length of the truncated subband filter coefficients of another subband.

In this case, the energy compensation may be performed when the flag information indicates that the length of the BRIR filter coefficients is not more than a predetermined value.

Further, the energy compensation may be performed by dividing filter coefficients up to a truncation point which is based on the filter order information by filter power up to the truncation point, and multiplying total filter power of the corresponding filter coefficients.

According to the exemplary embodiment, the method may further include performing reverberation processing of the subband signal corresponding to a period subsequent to the truncated subband filter coefficients among the subband filter coefficients when the flag information indicates that the length of the BRIR filter coefficients is more than the predetermined value.

Further, the characteristic information may include reverberation time information of the corresponding subband filter coefficients and the filter order information may have a single value for each subband.

Yet another exemplary embodiment of the present invention provides a method for generating a filter for an audio signal, including: receiving at least one time domain binaural room impulse response (BRIR) filter coefficients for binaural filtering of an input audio signal; obtaining propagation time information of the time domain BRIR filter coefficients, the propagation time information representing a time from an initial sample to direct sound of the BRIR filter coefficients; QMF-converting the time domain BRIR filter coefficients subsequent to the obtained propagation time information to generate a plurality of subband filter coefficients; obtaining filter order information for determining a truncation length of the subband filter coefficients by at least partially using characteristic information extracted from the subband filter coefficients, the filter order information of at least one subband being different from the filter order information of another subband; and truncating the subband filter coefficients based on the obtained filter order information.

Yet another exemplary embodiment of the present invention provides a parameterization device for generating a filter for an audio signal, wherein: the parameterization device receives at least one time domain binaural room impulse response (BRIR) filter coefficients for binaural filtering of an input audio signal; obtains propagation time information of the time domain BRIR filter coefficients, the propagation time information representing a time from an initial sample to direct sound of the BRIR filter coefficients; QMF-converts the time domain BRIR filter coefficients subsequent to the obtained propagation time information to generate a plurality of subband filter coefficients; obtains filter order information for determining a truncation length of the subband filter coefficients by at least partially using characteristic information extracted from the subband filter coefficients, the filter order information of at least one subband being different from the filter order information of another subband; and truncates the subband filter coefficients based on the obtained filter order information.

In this case, the obtaining the propagation time information further includes: measuring the frame energy by shifting a predetermined hop wise; identifying the first frame in which the frame energy is larger than a predetermined threshold; and obtaining the propagation time information based on position information of the identified first frame.

Further, the measuring the frame energy may measure an average value of the frame energy for each channel with respect to the same time interval.

According to the exemplary embodiment, the threshold may be determined to be a value which is lower than a maximum value of the measured frame energy by a predetermined proportion.

Further, the characteristic information may include reverberation time information of the corresponding subband filter coefficients, and the filter order information may have a single value for each subband.

Advantageous Effects

According to exemplary embodiments of the present invention, when binaural rendering for multi-channel or multi-object signals is performed, it is possible to remarkably decrease a computational complexity while minimizing the loss of sound quality.

According to the exemplary embodiments of the present invention, it is possible to achieve binaural rendering of high sound quality for multi-channel or multi-object audio signals of which real-time processing has been unavailable in the existing low-power device.

The present invention provides a method of efficiently performing filtering for various forms of multimedia signals including input audio signals with a low computational complexity

BEST MODE

As terms used in the specification, general terms which are currently widely used as possible by considering functions in the present invention are selected, but they may be changed depending on intentions of those skilled in the art, customs, or the appearance of a new technology. Further, in a specific case, terms arbitrarily selected by an applicant may be used and in this case, meanings thereof are described in the corresponding description part of the present invention. Therefore, it will be disclosed that the terms used in the specifications should be analyzed based on not just names of the terms but substantial meanings of the terms and contents throughout the specification.

Figure 1:
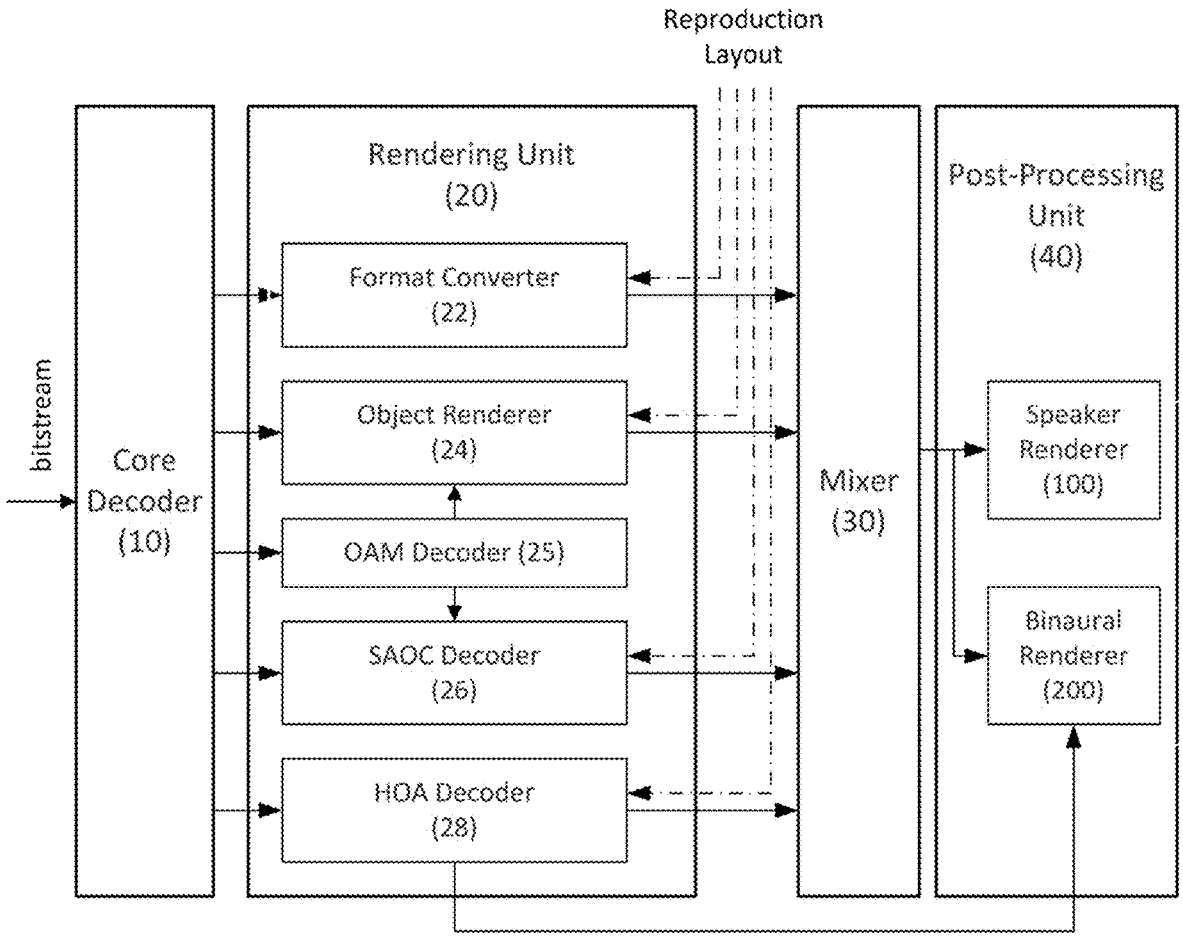
FIG. 1 is a block diagram illustrating an audio signal decoder according to an exemplary embodiment of the present invention.

FIG. 1 is a block diagram illustrating an audio signal decoder according to an exemplary embodiment of the present invention. The audio signal decoder according to the present invention includes a core decoder 10, a rendering unit 20, a mixer 30, and a post-processing unit 40.

First, the core decoder 10 decodes loudspeaker channel signals, discrete object signals, object downmix signals, and pre-rendered signals. According to an exemplary embodiment, in the core decoder 10, a codec based on unified speech and audio coding (USAC) may be used. The core decoder 10 decodes a received bitstream and transfers the decoded bitstream to the rendering unit 20.

The rendering unit 20 performs rendering signals decoded by the core decoder 10 by using reproduction layout information. The rendering unit 20 may include a format converter 22, an object renderer 24, an OAM decoder 25, an SAOC decoder 26, and an HOA decoder 28. The rendering unit 20 performs rendering by using any one of the above components according to the type of decoded signal.

The format converter 22 converts transmitted channel signals into output speaker channel signals. That is, the format converter 22 performs conversion between a transmitted channel configuration and a speaker channel configuration to be reproduced. When the number (for example, 5.1 channels) of output speaker channels is smaller than the number (for example, 22.2 channels) of transmitted channels or the transmitted channel configuration is different from the channel configuration to be reproduced, the format converter 22 performs downmix of transmitted channel signals. The audio signal decoder of the present invention may generate an optimal downmix matrix by using a combination of the input channel signals and the output speaker channel signals and perform the downmix by using the matrix. According to the exemplary embodiment of the present invention, the channel signals processed by the format converter 22 may include pre-rendered object signals. According to an exemplary embodiment, at least one object signal is pre-rendered before encoding the audio signal to be mixed with the channel signals. The mixed object signal as described above may be converted into the output speaker channel signal by the format converter 22 together with the channel signals.

The object renderer 24 and the SAOC decoder 26 perform rendering for an object based audio signals. The object based audio signal may include a discrete object waveform and a parametric object waveform. In the case of the discrete object waveform, each of the object signals is provided to an encoder in a monophonic waveform, and the encoder transmits each of the object signals by using single channel elements (SCEs). In the case of the parametric object waveform, a plurality of object signals is downmixed to at least one channel signal, and a feature of each object and the relationship among the objects are expressed as a spatial audio object coding (SAOC) parameter. The object signals are downmixed to be encoded to core codec and parametric information generated at this time is transmitted to a decoder together.

Meanwhile, when the discrete object waveform or the parametric object waveform is transmitted to an audio signal decoder, compressed object metadata corresponding thereto may be transmitted together. The object metadata quantizes an object attribute by the units of a time and a space to designate a position and a gain value of each object in 3D space. The OAM decoder 25 of the rendering unit 20 receives the compressed object metadata and decodes the received object metadata, and transfers the decoded object metadata to the object renderer 24 and/or the SAOC decoder 26.

The object renderer 24 performs rendering each object signal according to a given reproduction format by using the object metadata. In this case, each object signal may be rendered to specific output channels based on the object metadata. The SAOC decoder 26 restores the object/channel signal from decoded SAOC transmission channels and parametric information. The SAOC decoder 26 may generate an output audio signal based on the reproduction layout information and the object metadata. As such, the object renderer 24 and the SAOC decoder 26 may render the object signal to the channel signal.

The HOA decoder 28 receives Higher Order Ambisonics (HOA) coefficient signals and HOA additional information and decodes the received HOA coefficient signals and HOA additional information. The HOA decoder 28 models the channel signals or the object signals by a separate equation to generate a sound scene. When a spatial location of a speaker in the generated sound scene is selected, rendering to the loudspeaker channel signals may be performed.

Meanwhile, although not illustrated in FIG. 1, when the audio signal is transferred to each component of the rendering unit 20, dynamic range control (DRC) may be performed as a preprocessing process. The DRC limits a dynamic range of the reproduced audio signal to a predetermined level and adjusts a sound, which is smaller than a predetermined threshold, to be larger and a sound, which is larger than the predetermined threshold, to be smaller.

A channel based audio signal and the object based audio signal, which are processed by the rendering unit 20, are transferred to the mixer 30. The mixer 30 adjusts delays of a channel based waveform and a rendered object waveform, and sums up the adjusted waveforms by the unit of a sample. Audio signals summed up by the mixer 30 are transferred to the post-processing unit 40.

The post-processing unit 40 includes a speaker renderer 100 and a binaural renderer 200. The speaker renderer 100 performs post-processing for outputting the multi-channel and/or multi-object audio signals transferred from the mixer 30. The post-processing may include the dynamic range control (DRC), loudness normalization (LN), a peak limiter (PL), and the like.

The binaural renderer 200 generates a binaural downmix signal of the multi-channel and/or multi-object audio signals. The binaural downmix signal is a 2-channel audio signal that allows each input channel/object signal to be expressed by a virtual sound source positioned in 3D. The binaural renderer 200 may receive the audio signal provided to the speaker renderer 100 as an input signal. Binaural rendering may be performed based on binaural room impulse response (BRIR) filters and performed in a time domain or a QMF domain. According to an exemplary embodiment, as a post-processing process of the binaural rendering, the dynamic range control (DRC), the loudness normalization (LN), the peak limiter (PL), and the like may be additionally performed.

Figure 2:
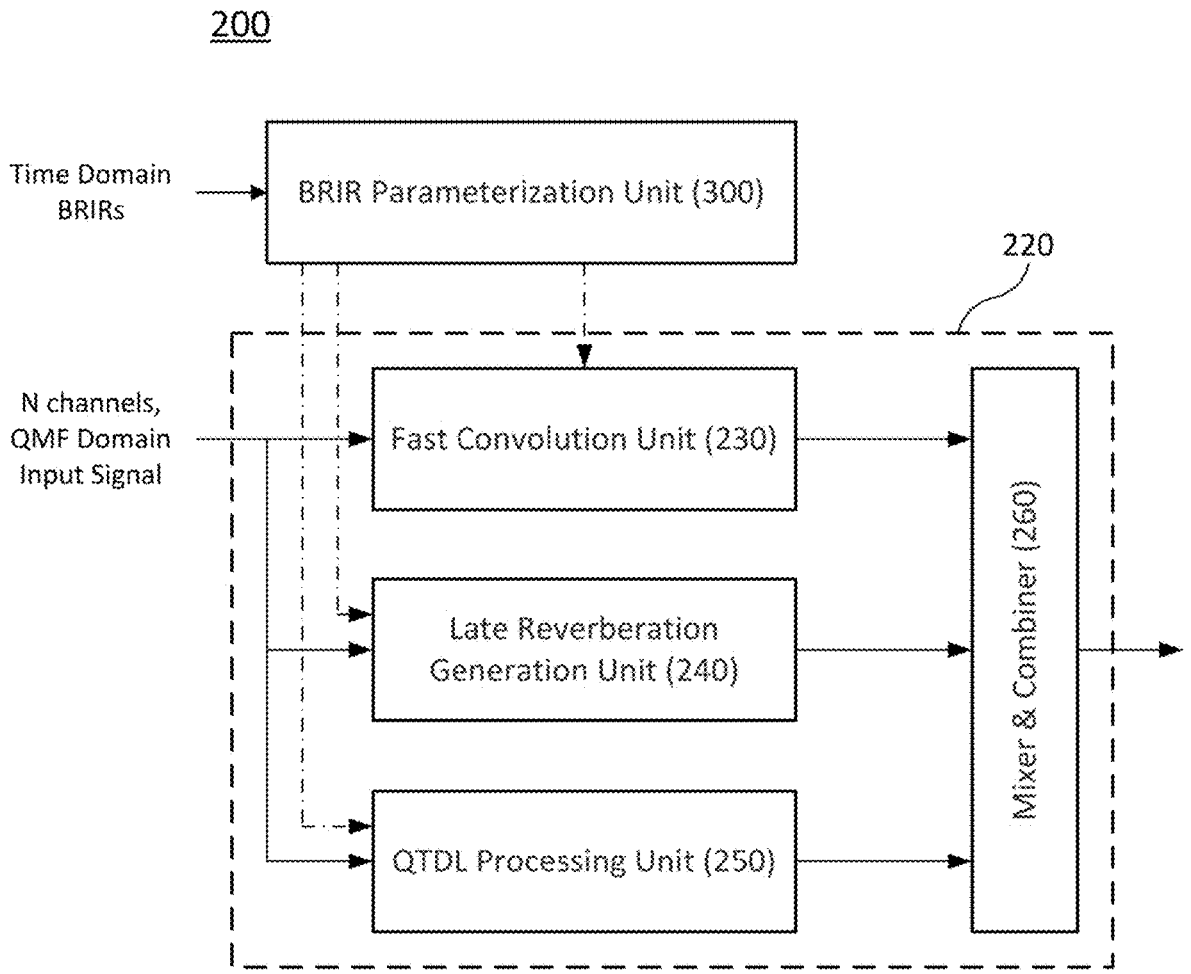
FIG. 2 is a block diagram illustrating each component of a binaural renderer according to an exemplary embodiment of the present invention.

FIG. 2 is a block diagram illustrating each component of a binaural renderer according to an exemplary embodiment of the present invention. As illustrated in FIG. 2, the binaural renderer 200 according to the exemplary embodiment of the present invention may include a BRIR parameterization unit 300, a fast convolution unit 230, a late reverberation generation unit 240, a QTDL processing unit 250, and a mixer & combiner 260.

The binaural renderer 200 generates a 3D audio headphone signal (that is, a 3D audio 2-channel signal) by performing binaural rendering of various types of input signals. In this case, the input signal may be an audio signal including at least one of the channel signals (that is, the loudspeaker channel signals), the object signals, and the HOA coefficient signals. According to another exemplary embodiment of the present invention, when the binaural renderer 200 includes a particular decoder, the input signal may be an encoded bitstream of the aforementioned audio signal. The binaural rendering converts the decoded input signal into the binaural downmix signal to make it possible to experience a surround sound at the time of hearing the corresponding binaural downmix signal through a headphone.

According to the exemplary embodiment of the present invention, the binaural renderer 200 may perform the binaural rendering of the input signal in the QMF domain. That is to say, the binaural renderer 200 may receive signals of multi-channels (N channels) of the QMF domain and perform the binaural rendering for the signals of the multi-channels by using a BRIR subband filter of the QMF domain. When a k-th subband signal of an i-th channel, which passed through a QMF analysis filter bank, is represented by $x_{k,i}(l)$ and a time index in a subband domain is represented by 1, the binaural rendering in the QMF domain may be expressed by an equation given below.

$$y_k^m(l) = \sum_i x_{k,i}(l) * b_{k,i}^m(l) \quad \text{[Equation 2]}$$

Herein, m is L or R, and $b_{k,i}^m(l)$ is obtained by converting the time domain BRIR filter into the subband filter of the QMF domain.

That is, the binaural rendering may be performed by a method that divides the channel signals or the object signals of the QMF domain into a plurality of subband signals and convolutes the respective subband signals with BRIR subband filters corresponding thereto, and thereafter, sums up the respective subband signals convoluted with the BRIR subband filters.

The BRIR parameterization unit 300 converts and edits BRIR filter coefficients for the binaural rendering in the QMF domain and generates various parameters. First, the BRIR parameterization unit 300 receives time domain BRIR filter coefficients for multi-channels or multi-objects, and converts the received time domain BRIR filter coefficients into QMF domain BRIR filter coefficients. In this case, the QMF domain BRIR filter coefficients include a plurality of subband filter coefficients corresponding to a plurality of frequency bands, respectively. In the present invention, the subband filter coefficients indicate each BRIR filter coefficients of a QMF-converted subband domain. In the specification, the subband filter coefficients may be designated as the BRIR subband filter coefficients. The BRIR parameterization unit 300 may edit each of the plurality of BRIR subband filter coefficients of the QMF domain and transfer the edited subband filter coefficients to the fast convolution unit 230, and the like. According to the exemplary embodiment of the present invention, the BRIR parameterization unit 300 may be included as a component of the binaural renderer 200 and, otherwise provided as a separate apparatus. According to an exemplary embodiment, a component including the fast convolution unit 230, the late reverberation generation unit 240, the QTDL processing unit 250, and the mixer & combiner 260, except for the BRIR parameterization unit 300, may be classified into a binaural rendering unit 220.

According to an exemplary embodiment, the BRIR parameterization unit 300 may receive BRIR filter coefficients corresponding to at least one location of a virtual reproduction space as an input. Each location of the virtual reproduction space may correspond to each speaker location of a multi-channel system. According to an exemplary embodiment, each of the BRIR filter coefficients received by the BRIR parameterization unit 300 may directly match each channel or each object of the input signal of the binaural renderer 200. On the contrary, according to another exemplary embodiment of the present invention, each of the received BRIR filter coefficients may have an independent configuration from the input signal of the binaural renderer 200. That is, at least a part of the BRIR filter coefficients received by the BRIR parameterization unit 300 may not directly match the input signal of the binaural renderer 200, and the number of received BRIR filter coefficients may be smaller or larger than the total number of channels and/or objects of the input signal.

The BRIR parameterization unit 300 may additionally receive control parameter information and generate a parameter for the binaural rendering based on the received control parameter information. The control parameter information may include a complexity-quality control parameter, and the like as described in an exemplary embodiment described below and be used as a threshold for various parameterization processes of the BRIR parameterization unit 300. The BRIR parameterization unit 300 generates a binaural rendering parameter based on the input value and transfers the generated binaural rendering parameter to the binaural rendering unit 220. When the input BRIR filter coefficients or the control parameter information is to be changed, the BRIR parameterization unit 300 may recalculate the binaural rendering parameter and transfer the recalculated binaural rendering parameter to the binaural rendering unit.

According to the exemplary embodiment of the present invention, the BRIR parameterization unit 300 converts and edits the BRIR filter coefficients corresponding to each channel or each object of the input signal of the binaural renderer 200 to transfer the converted and edited BRIR filter coefficients to the binaural rendering unit 220. The corresponding BRIR filter coefficients may be a matching BRIR or a fallback BRIR for each channel or each object. The BRIR matching may be determined whether BRIR filter coefficients targeting the location of each channel or each object are present in the virtual reproduction space. In this case, positional information of each channel (or object) may be obtained from an input parameter which signals the channel configuration. When the BRIR filter coefficients targeting at least one of the locations of the respective channels or the respective objects of the input signal are present, the BRIR filter coefficients may be the matching BRIR of the input signal. However, when the BRIR filter coefficients targeting the location of a specific channel or object is not present, the BRIR parameterization unit 300 may provide BRIR filter coefficients, which target a location most similar to the corresponding channel or object, as the fallback BRIR for the corresponding channel or object.

First, when there are BRIR filter coefficients having altitude and azimuth deviations within a predetermined range from a desired position (a specific channel or object), the corresponding BRIR filter coefficients may be selected. In other words, BRIR filter coefficients having the same altitude as and an azimuth deviation within +/−20 from the desired position may be selected. When there is no corresponding BRIR filter coefficient, BRIR filter coefficients having a minimum geometric distance from the desired position in a BRIR filter coefficients set may be selected. That is, BRIR filter coefficients to minimize a geometric distance between the position of the corresponding BRIR and the desired position may be selected. Herein, the position of the BRIR represents a position of the speaker corresponding to the relevant BRIR filter coefficients. Further, the geometric distance between both positions may be defined as a value acquired by summing up an absolute value of an altitude deviation and an absolute value of an azimuth deviation of both positions.

Meanwhile, according to another exemplary embodiment of the present invention, the BRIR parameterization unit 300 converts and edits all of the received BRIR filter coefficients to transfer the converted and edited BRIR filter coefficients to the binaural rendering unit 220. In this case, a selection procedure of the BRIR filter coefficients (alternatively, the edited BRIR filter coefficients) corresponding to each channel or each object of the input signal may be performed by the binaural rendering unit 220.

When the BRIR parameterization unit 300 is constituted by a device apart from the binaural rendering unit 220, the binaural rendering parameter generated by the BRIR parameterization unit 300 may be transmitted to the binaural rendering unit 220 as a bitstream. The binaural rendering unit 220 may obtain the binaural rendering parameter by decoding the received bitstream. In this case, the transmitted binaural rendering parameter includes various parameters required for processing in each sub unit of the binaural rendering unit 220 and may include the converted and edited BRIR filter coefficients, or the original BRIR filter coefficients.

The binaural rendering unit 220 includes a fast convolution unit 230, a late reverberation generation unit 240, and a QTDL processing unit 250 and receives multi-audio signals including multi-channel and/or multi-object signals. In the specification, the input signal including the multi-channel and/or multi-object signals will be referred to as the multi-audio signals. FIG. 2 illustrates that the binaural rendering unit 220 receives the multi-channel signals of the QMF domain according to an exemplary embodiment, but the input signal of the binaural rendering unit 220 may further include time domain multi-channel signals and time domain multi-object signals. Further, when the binaural rendering unit 220 additionally includes a particular decoder, the input signal may be an encoded bitstream of the multi-audio signals. Moreover, in the specification, the present invention is described based on a case of performing BRIR rendering of the multi-audio signals, but the present invention is not limited thereto. That is, features provided by the present invention may be applied to not only the BRIR but also other types of rendering filters and applied to not only the multi-audio signals but also an audio signal of a single channel or single object.

The fast convolution unit 230 performs a fast convolution between the input signal and the BRIR filter to process direct sound and early reflections sound for the input signal. To this end, the fast convolution unit 230 may perform the fast convolution by using a truncated BRIR. The truncated BRIR includes a plurality of subband filter coefficients truncated dependently on each subband frequency and is generated by the BRIR parameterization unit 300. In this case, the length of each of the truncated subband filter coefficients is determined dependently on a frequency of the corresponding subband. The fast convolution unit 230 may perform variable order filtering in a frequency domain by using the truncated subband filter coefficients having different lengths according to the subband. That is, the fast convolution may be performed between QMF domain subband audio signals and the truncated subband filters of the QMF domain corresponding thereto for each frequency band. In the specification, a direct sound and early reflections (D&E) part may be referred to as a front (F)-part.

The late reverberation generation unit 240 generates a late reverberation signal for the input signal. The late reverberation signal represents an output signal which follows the direct sound and the early reflections sound generated by the fast convolution unit 230. The late reverberation generation unit 240 may process the input signal based on reverberation time information determined by each of the subband filter coefficients transferred from the BRIR parameterization unit 300. According to the exemplary embodiment of the present invention, the late reverberation generation unit 240 may generate a mono or stereo downmix signal for an input audio signal and perform late reverberation processing of the generated downmix signal. In the specification, a late reverberation (LR) part may be referred to as a parametric (P)-part.

The QMF domain tapped delay line (QTDL) processing unit 250 processes signals in high-frequency bands among the input audio signals. The QTDL processing unit 250 receives at least one parameter, which corresponds to each subband signal in the high-frequency bands, from the BRIR parameterization unit 300 and performs tap-delay line filtering in the QMF domain by using the received parameter. According to the exemplary embodiment of the present invention, the binaural renderer 200 separates the input audio signals into low-frequency band signals and high-frequency band signals based on a predetermined constant or a predetermined frequency band, and the low-frequency band signals may be processed by the fast convolution unit 230 and the late reverberation generation unit 240, and the high frequency band signals may be processed by the QTDL processing unit 250, respectively.

Each of the fast convolution unit 230, the late reverberation generation unit 240, and the QTDL processing unit 250 outputs the 2-channel QMF domain subband signal. The mixer & combiner 260 combines and mixes the output signal of the fast convolution unit 230, the output signal of the late reverberation generation unit 240, and the output signal of the QTDL processing unit 250. In this case, the combination of the output signals is performed separately for each of left and right output signals of 2 channels. The binaural renderer 200 performs QMF synthesis to the combined output signals to generate a final output audio signal in the time domain.

Hereinafter, various exemplary embodiments of the fast convolution unit 230, the late reverberation generation unit 240, and the QTDL processing unit 250 which are illustrated in FIG. 2, and a combination thereof will be described in detail with reference to each drawing.

FIGS. 3 to 7 illustrate various exemplary embodiments of an apparatus for processing an audio signal according to the present invention. In the present invention, the apparatus for processing an audio signal may indicate the binaural renderer 200 or the binaural rendering unit 220, which is illustrated in FIG. 2, as a narrow meaning. However, in the present invention, the apparatus for processing an audio signal may indicate the audio signal decoder of FIG. 1, which includes the binaural renderer, as a broad meaning. Each binaural renderer illustrated in FIGS. 3 to 7 may indicate only some components of the binaural renderer 200 illustrated in FIG. 2 for the convenience of description. Further, hereinafter, in the specification, an exemplary embodiment of the multi-channel input signals will be primarily described, but unless otherwise described, a channel, multi-channels, and the multi-channel input signals may be used as concepts including an object, multi-objects, and the multi-object input signals, respectively. Moreover, the multi-channel input signals may also be used as a concept including an HOA decoded and rendered signal.

Figure 3:
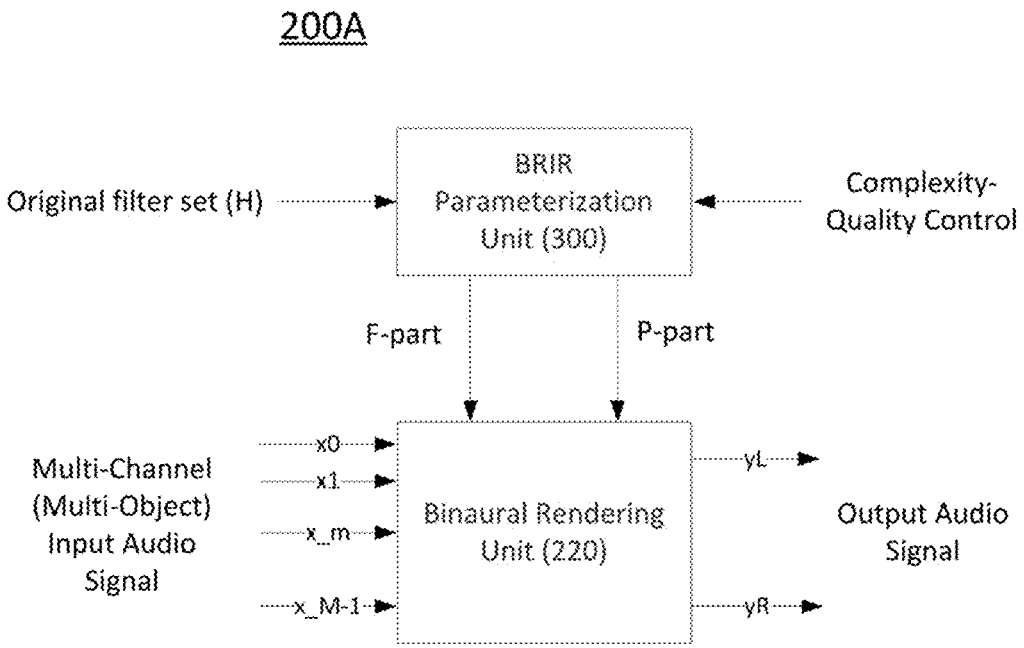
FIGS. 3 to 7 are diagrams illustrating various exemplary embodiments of an apparatus for processing an audio signal according to the present invention.

FIG. 3 illustrates a binaural renderer 200A according to an exemplary embodiment of the present invention. When the binaural rendering using the BRIR is generalized, the binaural rendering is M-to-O processing for acquiring O output signals for the multi-channel input signals having M channels. Binaural filtering may be regarded as filtering using filter coefficients corresponding to each input channel and each output channel during such a process. In FIG. 3, an original filter set H means transfer functions up to locations of left and right ears from a speaker location of each channel signal. A transfer function measured in a general listening room, that is, a reverberant space among the transfer functions is referred to as the binaural room impulse response (BRIR). On the contrary, a transfer function measured in an anechoic room so as not to be influenced by the reproduction space is referred to as a head related impulse response (HRIR), and a transfer function therefor is referred to as a head related transfer function (HRTF). Accordingly, differently from the HRTF, the BRIR contains information of the reproduction space as well as directional information. According to an exemplary embodiment, the BRIR may be substituted by using the HRTF and an artificial reverberator. In the specification, the binaural rendering using the BRIR is described, but the present invention is not limited thereto, and the present invention may be applied even to the binaural rendering using various types of FIR filters including HRIR and HRTF by a similar or a corresponding method. Furthermore, the present invention can be applied to various forms of filterings for input signals as well as the binaural rendering for the audio signals. Meanwhile, the BRIR may have a length of 96K samples as described above, and since multi-channel binaural rendering is performed by using different M*O filters, a processing process with a high computational complexity is required.

According to the exemplary embodiment of the present invention, the BRIR parameterization unit 300 may generate filter coefficients transformed from the original filter set H for optimizing the computational complexity. The BRIR parameterization unit 300 separates original filter coefficients into front (F)-part coefficients and parametric (P)-part coefficients. Herein, the F-part represents a direct sound and early reflections (D&E) part, and the P-part represents a late reverberation (LR) part. For example, original filter coefficients having a length of 96K samples may be separated into each of an F-part in which only front 4K samples are truncated and a P-part which is a part corresponding to residual 92K samples.

The binaural rendering unit 220 receives each of the F-part coefficients and the P-part coefficients from the BRIR parameterization unit 300 and performs rendering the multi-channel input signals by using the received coefficients. According to the exemplary embodiment of the present invention, the fast convolution unit 230 illustrated in FIG. 2 may render the multi-audio signals by using the F-part coefficients received from the BRIR parameterization unit 300, and the late reverberation generation unit 240 may render the multi-audio signals by using the P-part coefficients received from the BRIR parameterization unit 300. That is, the fast convolution unit 230 and the late reverberation generation unit 240 may correspond to an F-part rendering unit and a P-part rendering unit of the present invention, respectively. According to an exemplary embodiment, F-part rendering (binaural rendering using the F-part coefficients) may be implemented by a general finite impulse response (FIR) filter, and P-part rendering (binaural rendering using the P-part coefficients) may be implemented by a parametric method. Meanwhile, a complexity-quality control input provided by a user or a control system may be used to determine information generated to the F-part and/or the P-part.

Figure 4:
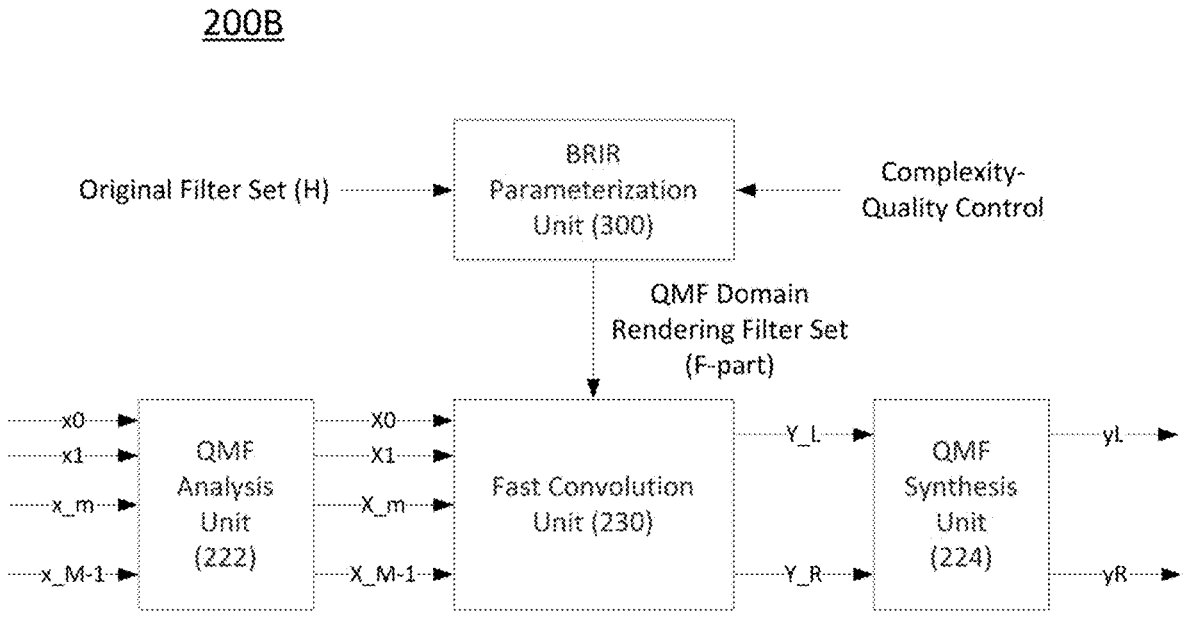

FIG. 4 illustrates a more detailed method that implements F-part rendering by a binaural renderer 200B according to another exemplary embodiment of the present invention. For the convenience of description, the P-part rendering unit is omitted in FIG. 4. Further, FIG. 4 illustrates a filter implemented in the QMF domain, but the present invention is not limited thereto and may be applied to subband processing of other domains.

Referring to FIG. 4, the F-part rendering may be performed by the fast convolution unit 230 in the QMF domain. For rendering in the QMF domain, a QMF analysis unit 222 converts time domain input signals x0, x1, . . . x_M−1 into QMF domain signals X0, X1, . . . X_M−1. In this case, the input signals x0, x1, . . . x_M−1 may be the multi-channel audio signals, that is, channel signals corresponding to the 22.2-channel speakers. In the QMF domain, a total of 64 subbands may be used, but the present invention is not limited thereto. Meanwhile, according to the exemplary embodiment of the present invention, the QMF analysis unit 222 may be omitted from the binaural renderer 200B. In the case of HE-AAC or USAC using spectral band replication (SBR), since processing is performed in the QMF domain, the binaural renderer 200B may immediately receive the QMF domain signals X0, X1, . . . X_M−1 as the input without QMF analysis. Accordingly, when the QMF domain signals are directly received as the input as described above, the QMF used in the binaural renderer according to the present invention is the same as the QMF used in the previous processing unit (that is, the SBR). A QMF synthesis unit 244 QMF-synthesizes left and right signals Y_L and Y_R of 2 channels, in which the binaural rendering is performed, to generate 2-channel output audio signals yL and yR of the time domain.

Figure 5:
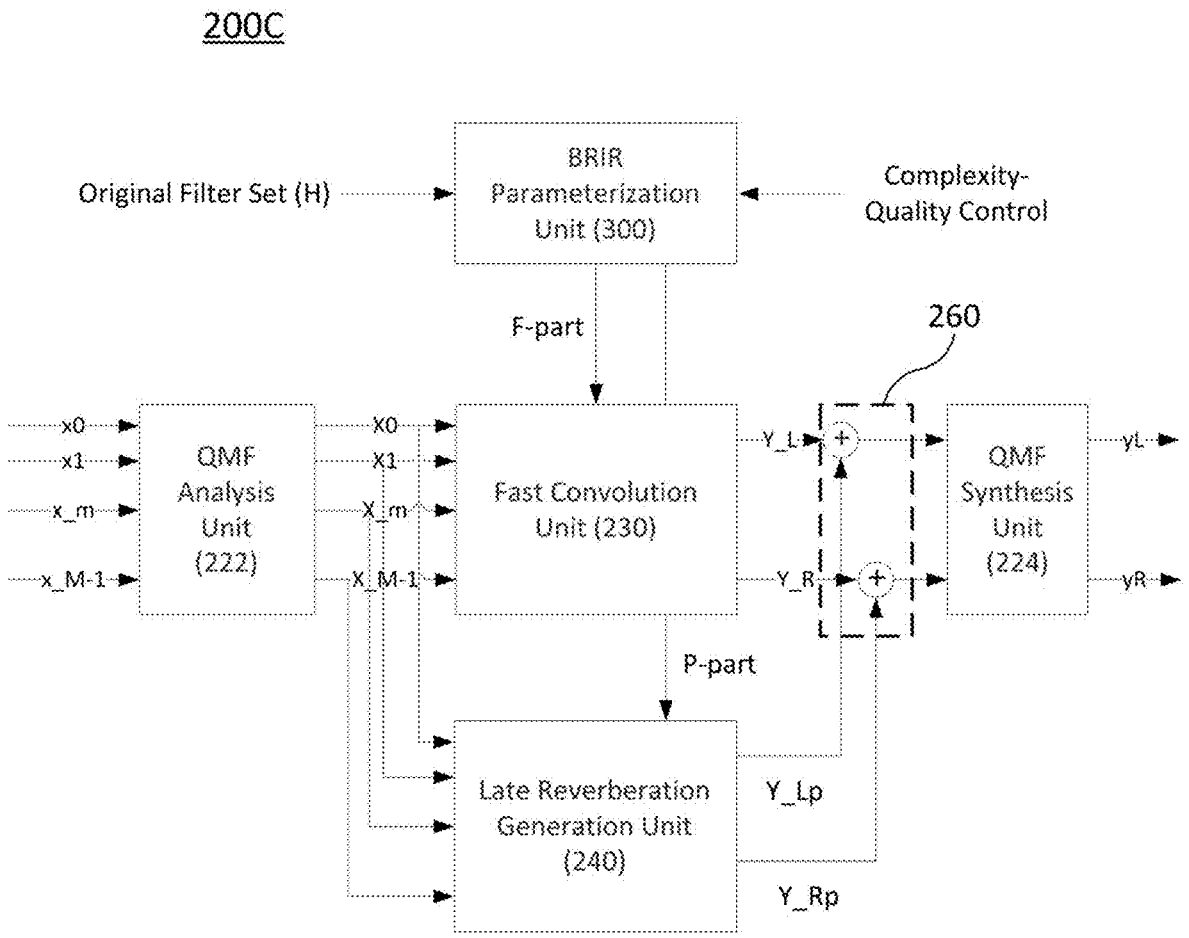
Figure 6:
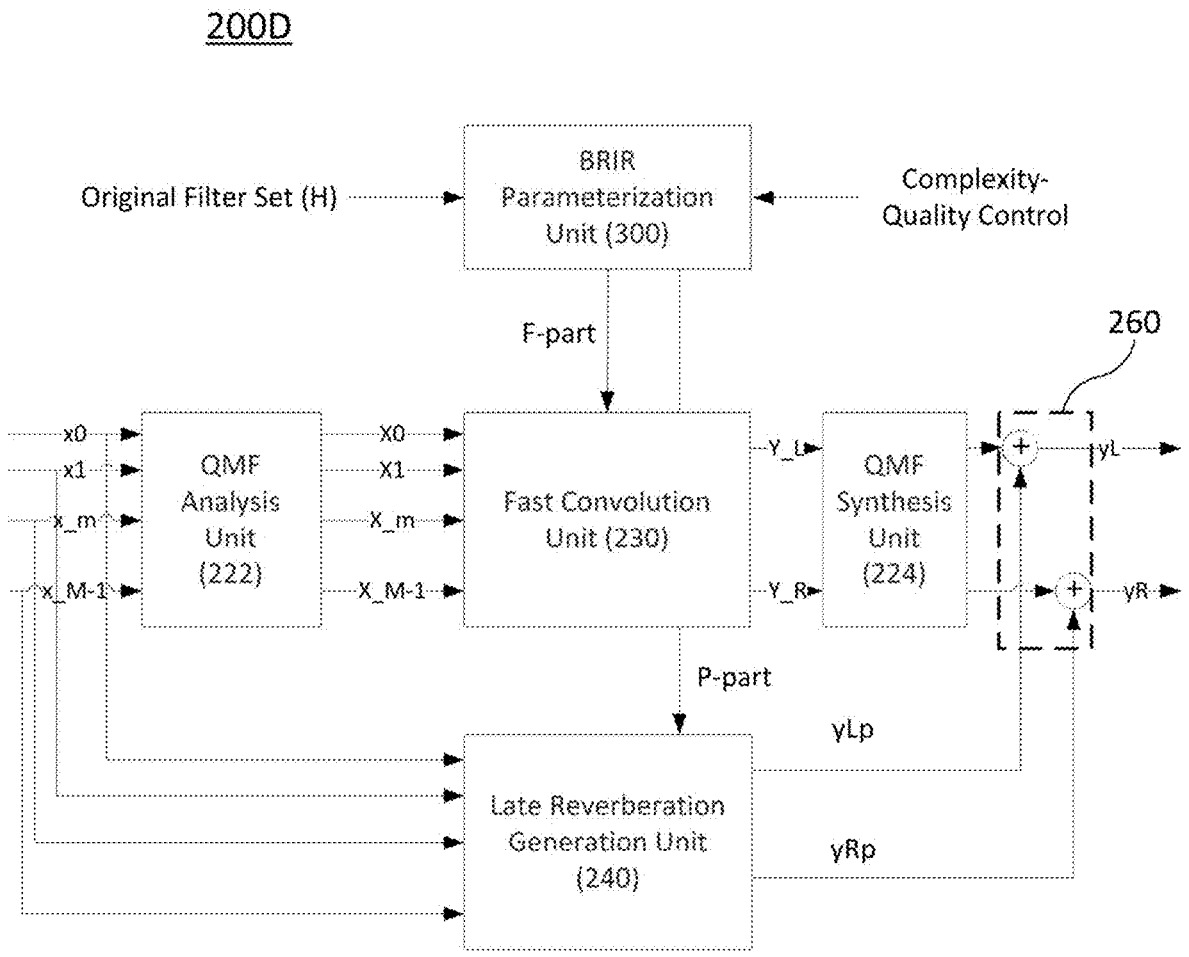
Figure 7:
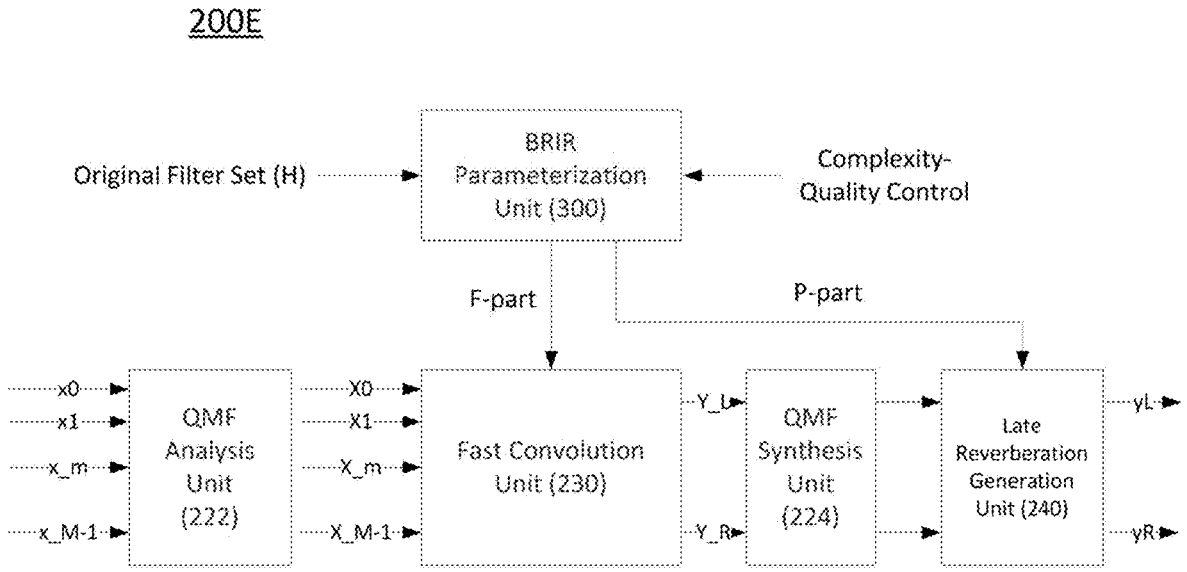

FIGS. 5 to 7 illustrate exemplary embodiments of binaural renderers 200C, 200D, and 200E, which perform both F-part rendering and P-part rendering, respectively. In the exemplary embodiments of FIGS. 5 to 7, the F-part rendering is performed by the fast convolution unit 230 in the QMF domain, and the P-part rendering is performed by the late reverberation generation unit 240 in the QMF domain or the time domain. In the exemplary embodiments of FIGS. 5 to 7, detailed description of parts duplicated with the exemplary embodiments of the previous drawings will be omitted.

Referring to FIG. 5, the binaural renderer 200C may perform both the F-part rendering and the P-part rendering in the QMF domain. That is, the QMF analysis unit 222 of the binaural renderer 200C converts time domain input signals x0, x1, . . . x_M−1 into QMF domain signals X0, X1, . . . X_M−1 to transfer each of the converted QMF domain signals X0, X1, . . . X_M−1 to the fast convolution unit 230 and the late reverberation generation unit 240. The fast convolution unit 230 and the late reverberation generation unit 240 render the QMF domain signals X0, X1, . . . X_M−1 to generate 2-channel output signals Y_L, Y_R and Y_Lp, Y_Rp, respectively. In this case, the fast convolution unit 230 and the late reverberation generation unit 240 may perform rendering by using the F-part filter coefficients and the P-part filter coefficients received by the BRIR parameterization unit 300, respectively. The output signals Y_L and Y_R of the F-part rendering and the output signals Y_Lp and Y_Rp of the P-part rendering are combined for each of the left and right channels in the mixer & combiner 260 and transferred to the QMF synthesis unit 224. The QMF synthesis unit 224 QMF-synthesizes input left and right signals of 2 channels to generate 2-channel output audio signals yL and yR of the time domain.

Referring to FIG. 6, the binaural renderer 200D may perform the F-part rendering in the QMF domain and the P-part rendering in the time domain. The QMF analysis unit 222 of the binaural renderer 200D QMF-converts the time domain input signals and transfers the converted time domain input signals to the fast convolution unit 230. The fast convolution unit 230 performs F-part rendering the QMF domain signals to generate the 2-channel output signals Y_L and Y_R. The QMF synthesis unit 224 converts the output signals of the F-part rendering into the time domain output signals and transfers the converted time domain output signals to the mixer & combiner 260. Meanwhile, the late reverberation generation unit 240 performs the P-part rendering by directly receiving the time domain input signals. The output signals yLp and yRp of the P-part rendering are transferred to the mixer & combiner 260. The mixer & combiner 260 combines the F-part rendering output signal and the P-part rendering output signal in the time domain to generate the 2-channel output audio signals yL and yR in the time domain.

In the exemplary embodiments of FIGS. 5 and 6, the F-part rendering and the P-part rendering are performed in parallel, while according to the exemplary embodiment of FIG. 7, the binaural renderer 200E may sequentially perform the F-part rendering and the P-part rendering. That is, the fast convolution unit 230 may perform F-part rendering the QMF-converted input signals, and the QMF synthesis unit 224 may convert the F-part-rendered 2-channel signals Y_L and Y_R into the time domain signal and thereafter, transfer the converted time domain signal to the late reverberation generation unit 240. The late reverberation generation unit 240 performs P-part rendering the input 2-channel signals to generate 2-channel output audio signals yL and yR of the time domain.

FIGS. 5 to 7 illustrate exemplary embodiments of performing the F-part rendering and the P-part rendering, respectively, and the exemplary embodiments of the respective drawings are combined and modified to perform the binaural rendering. That is to say, in each exemplary embodiment, the binaural renderer may downmix the input signals into the 2-channel left and right signals or a mono signal and thereafter perform P-part rendering the downmix signal as well as discretely performing the P-part rendering each of the input multi-audio signals.

<Variable Order Filtering in Frequency-Domain (VOFF)>

Figure 8:
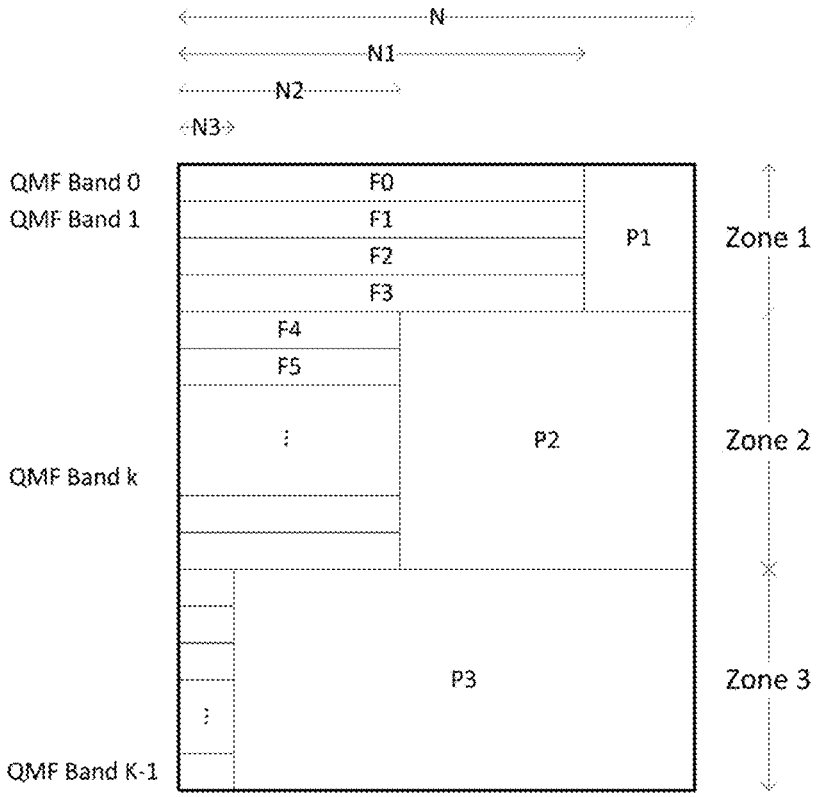
FIGS. 8 to 10 are diagrams illustrating methods for generating an FIR filter for binaural rendering according to exemplary embodiments of the present invention.
Figure 9:
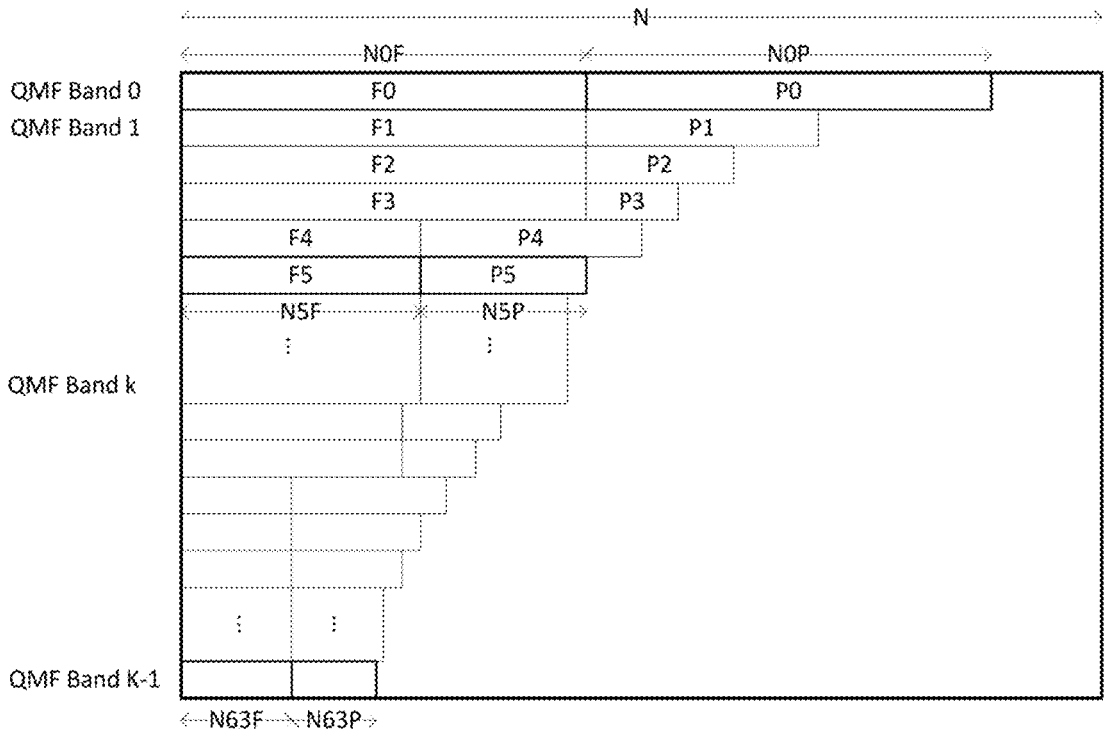
Figure 10:
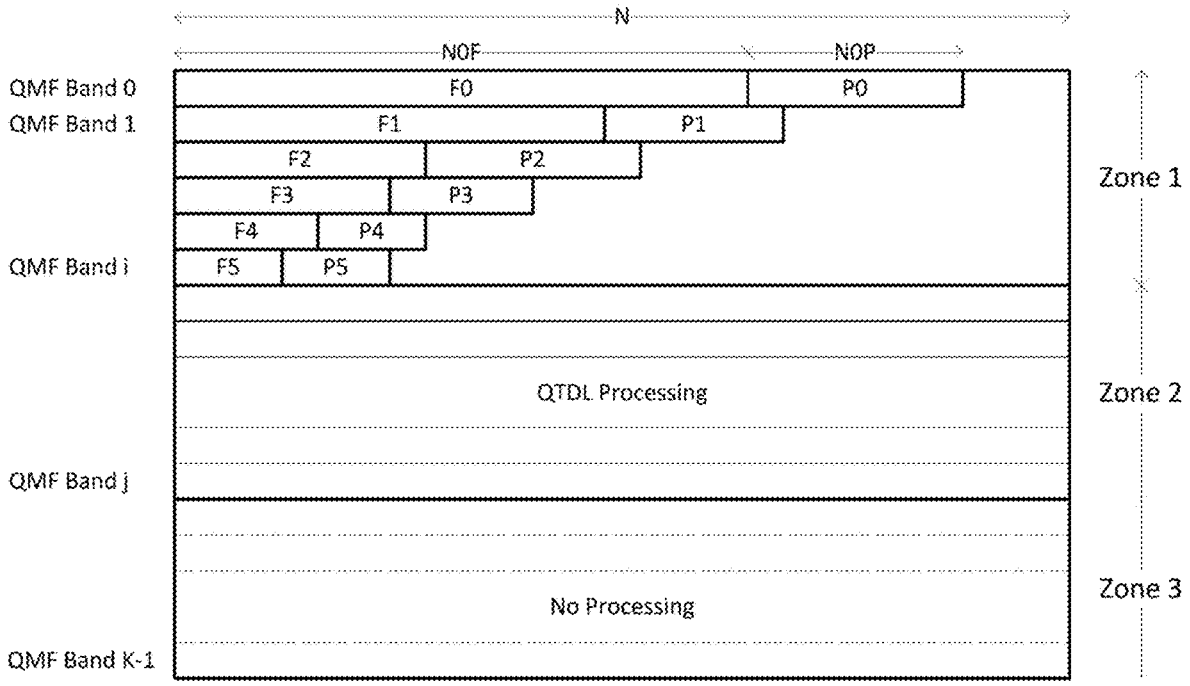

FIGS. 8 to 10 illustrate methods for generating an FIR filter for binaural rendering according to exemplary embodiments of the present invention. According to the exemplary embodiments of the present invention, an FIR filter, which is converted into the plurality of subband filters of the QMF domain, may be used for the binaural rendering in the QMF domain. In this case, subband filters truncated dependently on each subband may be used for the F-part rendering. That is, the fast convolution unit of the binaural renderer may perform variable order filtering in the QMF domain by using the truncated subband filters having different lengths according to the subband. Hereinafter, the exemplary embodiments of the filter generation in FIGS. 8 to 10, which will be described below, may be performed by the BRIR parameterization unit 300 of FIG. 2.

FIG. 8 illustrates an exemplary embodiment of a length according to each QMF band of a QMF domain filter used for binaural rendering. In the exemplary embodiment of FIG. 8, the FIR filter is converted into K QMF subband filters, and Fk represents a truncated subband filter of a QMF subband k. In the QMF domain, a total of 64 subbands may be used, but the present invention is not limited thereto. Further, N represents the length (the number of taps) of the original subband filter, and the lengths of the truncated subband filters are represented by N1, N2, and N3, respectively. In this case, the lengths N, N1, N2, and N3 represent the number of taps in a downsampled QMF domain.

According to the exemplary embodiment of the present invention, the truncated subband filters having different lengths N1, N2, and N3 according to each subband may be used for the F-part rendering. In this case, the truncated subband filter is a front filter truncated in the original subband filter and may be also designated as a front subband filter. Further, a rear part after truncating the original subband filter may be designated as a rear subband filter and used for the P-part rendering.

In the case of rendering using the BRIR filter, a filter order (that is, filter length) for each subband may be determined based on parameters extracted from an original BRIR filter, that is, reverberation time (RT) information for each subband filter, an energy decay curve (EDC) value, energy decay time information, and the like. A reverberation time may vary depending on the frequency due to acoustic characteristics in which decay in air and a sound-absorption degree depending on materials of a wall and a ceiling vary for each frequency. In general, a signal having a lower frequency has a longer reverberation time. Since the long reverberation time means that more information remains in the rear part of the FIR filter, it is preferable to truncate the corresponding filter long in normally transferring reverberation information. Accordingly, the length of each truncated subband filter of the present invention is determined based at least in part on the characteristic information (for example, reverberation time information) extracted from the corresponding subband filter.

The length of the truncated subband filter may be determined according to various exemplary embodiments. First, according to an exemplary embodiment, each subband may be classified into a plurality of groups, and the length of each truncated subband filter may be determined according to the classified groups. According to an example of FIG. 8, each subband may be classified into three zones Zone 1, Zone 2, and Zone 3, and truncated subband filters of Zone 1 corresponding to a low frequency may have a longer filter order (that is, filter length) than truncated subband filters of Zone 2 and Zone 3 corresponding to a high frequency. Further, the filter order of the truncated subband filter of the corresponding zone may gradually decrease toward a zone having a high frequency.

According to another exemplary embodiment of the present invention, the length of each truncated subband filter may be determined independently and variably for each subband according to characteristic information of the original subband filter. The length of each truncated subband filter is determined based on the truncation length determined in the corresponding subband and is not influenced by the length of a truncated subband filter of a neighboring or another subband. That is to say, the lengths of some or all truncated subband filters of Zone 2 may be longer than the length of at least one truncated subband filter of Zone 1.

According to yet another exemplary embodiment of the present invention, the variable order filtering in frequency domain may be performed with respect to only some of subbands classified into the plurality of groups. That is, truncated subband filters having different lengths may be generated with respect to only subbands that belong to some group(s) among at least two classified groups. According to an exemplary embodiment, the group in which the truncated subband filter is generated may be a subband group (that is to say, Zone 1 ) classified into low-frequency bands based on a predetermined constant or a predetermined frequency band. For example, when the sampling frequency of the original BRIR filter is 48 kHz, the original BRIR filter may be transformed to a total of 64 QMF subband filters (K=64). In this case, the truncated subband filters may be generated only with respect to subbands corresponding to 0 to 12 kHz bands which are half of all 0 to 24 kHz bands, that is, a total of 32 subbands having indexes 0 to 31 in the order of low frequency bands. In this case, according to the exemplary embodiment of the present invention, a length of the truncated subband filter of the subband having the index of 0 is larger than that of the truncated subband filter of the subband having the index of 31.

The length of the truncated filter may be determined based on additional information obtained by the apparatus for processing an audio signal, that is, complexity, a complexity level (profile), or required quality information of the decoder. The complexity may be determined according to a hardware resource of the apparatus for processing an audio signal or a value directly input by the user. The quality may be determined according to a request of the user or determined with reference to a value transmitted through the bitstream or other information included in the bitstream. Further, the quality may also be determined according to a value obtained by estimating the quality of the transmitted audio signal, that is to say, as a bit rate is higher, the quality may be regarded as a higher quality. In this case, the length of each truncated subband filter may proportionally increase according to the complexity and the quality and may vary with different ratios for each band. Further, in order to acquire an additional gain by high-speed processing such as FFT to be described below, and the like, the length of each truncated subband filter may be determined as a size unit corresponding to the additional gain, that is to say, a multiple of the power of 2. On the contrary, when the determined length of the truncated subband filter is longer than a total length of an actual subband filter, the length of the truncated subband filter may be adjusted to the length of the actual subband filter.

The BRIR parameterization unit generates the truncated subband filter coefficients (F-part coefficients) corresponding to the respective truncated subband filters determined according to the aforementioned exemplary embodiment, and transfers the generated truncated subband filter coefficients to the fast convolution unit. The fast convolution unit performs the variable order filtering in frequency domain of each subband signal of the multi-audio signals by using the truncated subband filter coefficients. That is, in respect to a first subband and a second subband which are different frequency bands with each other, the fast convolution unit generates a first subband binaural signal by applying a first truncated subband filter coefficients to the first subband signal and generates a second subband binaural signal by applying a second truncated subband filter coefficients to the second subband signal. In this case, the first truncated subband filter coefficients and the second truncated subband filter coefficients may have different lengths and are obtained from the same proto-type filter in the time domain.

FIG. 9 illustrates another exemplary embodiment of a length for each QMF band of a QMF domain filter used for binaural rendering. In the exemplary embodiment of FIG. 9, duplicative description of parts, which are the same as or correspond to the exemplary embodiment of FIG. 8, will be omitted.

In the exemplary embodiment of FIG. 9, Fk represents a truncated subband filter (front subband filter) used for the F-part rendering of the QMF subband k, and Pk represents a rear subband filter used for the P-part rendering of the QMF subband k. N represents the length (the number of taps) of the original subband filter, and NkF and NkP represent the lengths of a front subband filter and a rear subband filter of the subband k, respectively. As described above, NkF and NkP represent the number of taps in the downsampled QMF domain.

According to the exemplary embodiment of FIG. 9, the length of the rear subband filter may also be determined based on the parameters extracted from the original subband filter as well as the front subband filter. That is, the lengths of the front subband filter and the rear subband filter of each subband are determined based at least in part on the characteristic information extracted in the corresponding subband filter. For example, the length of the front subband filter may be determined based on first reverberation time information of the corresponding subband filter, and the length of the rear subband filter may be determined based on second reverberation time information. That is, the front subband filter may be a filter at a truncated front part based on the first reverberation time information in the original subband filter, and the rear subband filter may be a filter at a rear part corresponding to a zone between a first reverberation time and a second reverberation time as a zone which follows the front subband filter. According to an exemplary embodiment, the first reverberation time information may be RT20, and the second reverberation time information may be RT60, but the present invention is not limited thereto.

A part where an early reflections sound part is switched to a late reverberation sound part is present within a second reverberation time. That is, a point is present, where a zone having a deterministic characteristic is switched to a zone having a stochastic characteristic, and the point is called a mixing time in terms of the BRIR of the entire band. In the case of a zone before the mixing time, information providing directionality for each location is primarily present, and this is unique for each channel. On the contrary, since the late reverberation part has a common feature for each channel, it may be efficient to process a plurality of channels at once. Accordingly, the mixing time for each subband is estimated to perform the fast convolution through the F-part rendering before the mixing time and perform processing in which a common characteristic for each channel is reflected through the P-part rendering after the mixing time.

However, an error may occur by a bias from a perceptual viewpoint at the time of estimating the mixing time. Therefore, performing the fast convolution by maximizing the length of the F-part is more excellent from a quality viewpoint than separately processing the F-part and the P-part based on the corresponding boundary by estimating an accurate mixing time. Therefore, the length of the F-part, that is, the length of the front subband filter may be longer or shorter than the length corresponding to the mixing time according to complexity-quality control.

Moreover, in order to reduce the length of each subband filter, in addition to the aforementioned truncation method, when a frequency response of a specific subband is monotonic, modeling that reduces the filter of the corresponding subband to a low order is available. As a representative method, there is FIR filter modeling using frequency sampling, and a filter minimized from a least square viewpoint may be designed.

According to the exemplary embodiment of the present invention, the lengths of the front subband filter and/or the rear subband filter for each subband may have the same value for each channel of the corresponding subband. An error in measurement may be present in the BRIR, and an error element such as the bias, or the like is present even in estimating the reverberation time. Accordingly, in order to reduce the influence, the length of the filter may be determined based on a mutual relationship between channels or between subbands. According to an exemplary embodiment, the BRIR parameterization unit may extract first characteristic information (that is to say, the first reverberation time information) from the subband filter corresponding to each channel of the same subband and acquire single filter order information (alternatively, first truncation point information)

for the corresponding subband by combining the extracted first characteristic information. The front subband filter for each channel of the corresponding subband may be determined to have the same length based on the obtained filter order information (alternatively, first truncation point information). Similarly, the BRIR parameterization unit may extract second characteristic information (that is to say, the second reverberation time information) from the subband filter corresponding to each channel of the same subband and acquire second truncation point information, which is to be commonly applied to the rear subband filter corresponding to each channel of the corresponding subband, by combining the extracted second characteristic information. Herein, the front subband filter may be a filter at a truncated front part based on the first truncation point information in the original subband filter, and the rear subband filter may be a filter at a rear part corresponding to a zone between the first truncation point and the second truncation point as a zone which follows the front subband filter.

Meanwhile, according to another exemplary embodiment of the present invention, only the F-part processing may be performed with respect to subbands of a specific subband group. In this case, when processing is performed with respect to the corresponding subband by using only a filter up to the first truncation point, distortion at a level for the user to perceive may occur due to a difference in energy of processed filter as compared with the case in which the processing is performed by using the whole subband filter. In order to prevent the distortion, energy compensation for an area which is not used for the processing, that is, an area following the first truncation point may be achieved in the corresponding subband filter. The energy compensation may be performed by dividing the F-part coefficients (front subband filter coefficients) by filter power up to the first truncation point of the corresponding subband filter and multiplying the divided F-part coefficients (front subband filter coefficients) by energy of a desired area, that is, total power of the corresponding subband filter. Accordingly, the energy of the F-part coefficients may be adjusted to be the same as the energy of the whole subband filter. Further, although the P part coefficients are transmitted from the BRIR parameterization unit, the binaural rendering unit may not perform the P-part processing based on the complexity-quality control. In this case, the binaural rendering unit may perform the energy compensation for the F-part coefficients by using the P-part coefficients.

In the F-part processing by the aforementioned methods, the filter coefficients of the truncated subband filters having different lengths for each subband are obtained from a single time domain filter (that is, a proto-type filter). That is, since the single time domain filter is converted into a plurality of QMF subband filters and the lengths of the filters corresponding to each subband are varied, each truncated subband filter is obtained from a single proto-type filter.

The BRIR parameterization unit generates the front subband filter coefficients (F-part coefficients) corresponding to each front subband filter determined according to the aforementioned exemplary embodiment and transfers the generated front subband filter coefficients to the fast convolution unit. The fast convolution unit performs the variable order filtering in frequency domain of each subband signal of the multi-audio signals by using the received front subband filter coefficients. That is, in respect to the first subband and the second subband which are the different frequency bands with each other, the fast convolution unit generates a first subband binaural signal by applying a first front subband filter coefficients to the first subband signal and generates a second subband binaural signal by applying a second front subband filter coefficients to the second subband signal. In this case, the first front subband filter coefficient and the second front subband filter coefficient may have different lengths and are obtained from the same proto-type filter in the time domain. Further, the BRIR parameterization unit may generate the rear subband filter coefficients (P-part coefficients) corresponding to each rear subband filter determined according to the aforementioned exemplary embodiment and transfer the generated rear subband filter coefficients to the late reverberation generation unit. The late reverberation generation unit may perform reverberation processing of each subband signal by using the received rear subband filter coefficients. According to the exemplary embodiment of the present invention, the BRIR parameterization unit may combine the rear subband filter coefficients for each channel to generate downmix subband filter coefficients (downmix P-part coefficients) and transfer the generated downmix subband filter coefficients to the late reverberation generation unit. As described below, the late reverberation generation unit may generate 2-channel left and right subband reverberation signals by using the received downmix subband filter coefficients.

FIG. 10 illustrates yet another exemplary embodiment of a method for generating an FIR filter used for binaural rendering. In the exemplary embodiment of FIG. 10, duplicative description of parts, which are the same as or correspond to the exemplary embodiment of FIGS. 8 and 9, will be omitted.

Referring to FIG. 10, the plurality of subband filters, which are QMF-converted, may be classified into the plurality of groups, and different processing may be applied for each of the classified groups. For example, the plurality of subbands may be classified into a first subband group Zone 1 having low frequencies and a second subband group Zone 2 having high frequencies based on a predetermined frequency band (QMF band i). In this case, the F-part rendering may be performed with respect to input subband signals of the first subband group, and QTDL processing to be described below may be performed with respect to input subband signals of the second subband group.

Accordingly, the BRIR parameterization unit generates the front subband filter coefficients for each subband of the first subband group and transfers the generated front subband filter coefficients to the fast convolution unit. The fast convolution unit performs the F-part rendering of the subband signals of the first subband group by using the received front subband filter coefficients. According to an exemplary embodiment, the P-part rendering of the subband signals of the first subband group may be additionally performed by the late reverberation generation unit. Further, the BRIR parameterization unit obtains at least one parameter from each of the subband filter coefficients of the second subband group and transfers the obtained parameter to the QTDL processing unit. The QTDL processing unit performs tap-delay line filtering of each subband signal of the second subband group as described below by using the obtained parameter. According to the exemplary embodiment of the present invention, the predetermined frequency (QMF band i) for distinguishing the first subband group and the second subband group may be determined based on a predetermined constant value or determined according to a bitstream characteristic of the transmitted audio input signal. For example, in the case of the audio signal using the SBR, the second subband group may be set to correspond to an SBR bands.

According to another exemplary embodiment of the present invention, the plurality of subbands may be classified into three subband groups based on a predetermined first frequency band (QMF band i) and a predetermined second frequency band (QMF band j). That is, the plurality of subbands may be classified into a first subband group Zone 1 which is a low-frequency zone equal to or lower than the first frequency band, a second subband group Zone 2 which is an intermediate-frequency zone higher than the first frequency band and equal to or lower than the second frequency band, and a third subband group Zone 3 which is a high-frequency zone higher than the second frequency band. For example, when a total of 64 QMF subbands (subband indexes 0 to 63) are divided into the 3 subband groups, the first subband group may include a total of 32 subbands having indexes 0 to 31, the second subband group may include a total of 16 subbands having indexes 32 to 47, and the third subband group may include subbands having residual indexes 48 to 63. Herein, the subband index has a lower value as a subband frequency becomes lower.

According to the exemplary embodiment of the present invention, the binaural rendering may be performed only with respect to subband signals of the first and second subband groups. That is, as described above, the F-part rendering and the P-part rendering may be performed with respect to the subband signals of the first subband group and the QTDL processing may be performed with respect to the subband signals of the second subband group. Further, the binaural rendering may not be performed with respect to the subband signals of the third subband group. Meanwhile, information (Kproc=48) of a maximum frequency band to perform the binaural rendering and information (Kconv=32) of a frequency band to perform the convolution may be predetermined values or be determined by the BRIR parameterization unit to be transferred to the binaural rendering unit. In this case, a first frequency band (QMF band i) is set as a subband of an index Kconv−1 and a second frequency band (QMF band j) is set as a subband of an index Kproc−1. Meanwhile, the values of the information (Kproc) of the maximum frequency band and the information (Kconv) of the frequency band to perform the convolution may be varied by a sampling frequency of an original BRIR input, a sampling frequency of an input audio signal, and the like.

<Late Reverberation Rendering>

Next, various exemplary embodiments of the P-part rendering of the present invention will be described with reference to FIG. 11. That is, various exemplary embodiments of the late reverberation generation unit 240 of FIG. 2, which performs the P-part rendering in the QMF domain, will be described with reference to FIG. 11. In the exemplary embodiments of FIG. 11, it is assumed that the multi-channel input signals are received as the subband signals of the QMF domain. Accordingly, processing of respective components of late reverberation generation unit 240 of FIG. 11 may be performed for each QMF subband. In the exemplary embodiments of FIG. 11, detailed description of parts duplicated with the exemplary embodiments of the previous drawings will be omitted.

In the exemplary embodiments of FIGS. 8 to 10, Pk (P1, P2, P3, . . . ) corresponding to the P-part is a rear part of each subband filter removed by frequency variable truncation and generally includes information on late reverberation. The length of the P-part may be defined as a whole filter after a truncation point of each subband filter according to the complexity-quality control, or defined as a smaller length with reference to the second reverberation time information of the corresponding subband filter.

The P-part rendering may be performed independently for each channel or performed with respect to a downmixed channel. Further, the P-part rendering may be applied through different processing for each predetermined subband group or for each subband, or applied to all subbands as the same processing. In this case, processing applicable to the P-part may include energy decay compensation, tap-delay line filtering, processing using an infinite impulse response (IIR) filter, processing using an artificial reverberator, frequency-independent interaural coherence (FIIC) compensation, frequency-dependent interaural coherence (FDIC) compensation, and the like for input signals.

Meanwhile, it is important to generally conserve two features, that is, features of energy decay relief (EDR) and frequency-dependent interaural coherence (FDIC) for parametric processing for the P-part. First, when the P-part is observed from an energy viewpoint, it can be seen that the EDR may be the same or similar for each channel. Since the respective channels have common EDR, it is appropriate to downmix all channels to one or two channel(s) and thereafter, perform the P-part rendering of the downmixed channel(s) from the energy viewpoint. In this case, an operation of the P-part rendering, in which M convolutions need to be performed with respect to M channels, is decreased to the M-to-O downmix and one (alternatively, two) convolution, thereby providing a gain of a significant computational complexity. When energy decay matching and FDIC compensation are performed with respect to a downmix signal as described above, late reverberation for the multi-channel input signal may be more efficiently implemented. As a method for downmixing the multi-channel input signal, a method of adding all channels so that the respective channels have the same gain value may be used. According to another exemplary embodiment of the present invention, left channels of the multi-channel input signal may be added while being allocated to a stereo left channel and right channels may be added while being allocated to a stereo right channel. In this case, channels positioned at front and rear sides (0° and 180°) are normalized with the same power (e.g., a gain value of 1/sqrt(2)) and distributed to the stereo left channel and the stereo right channel.

Figure 11:
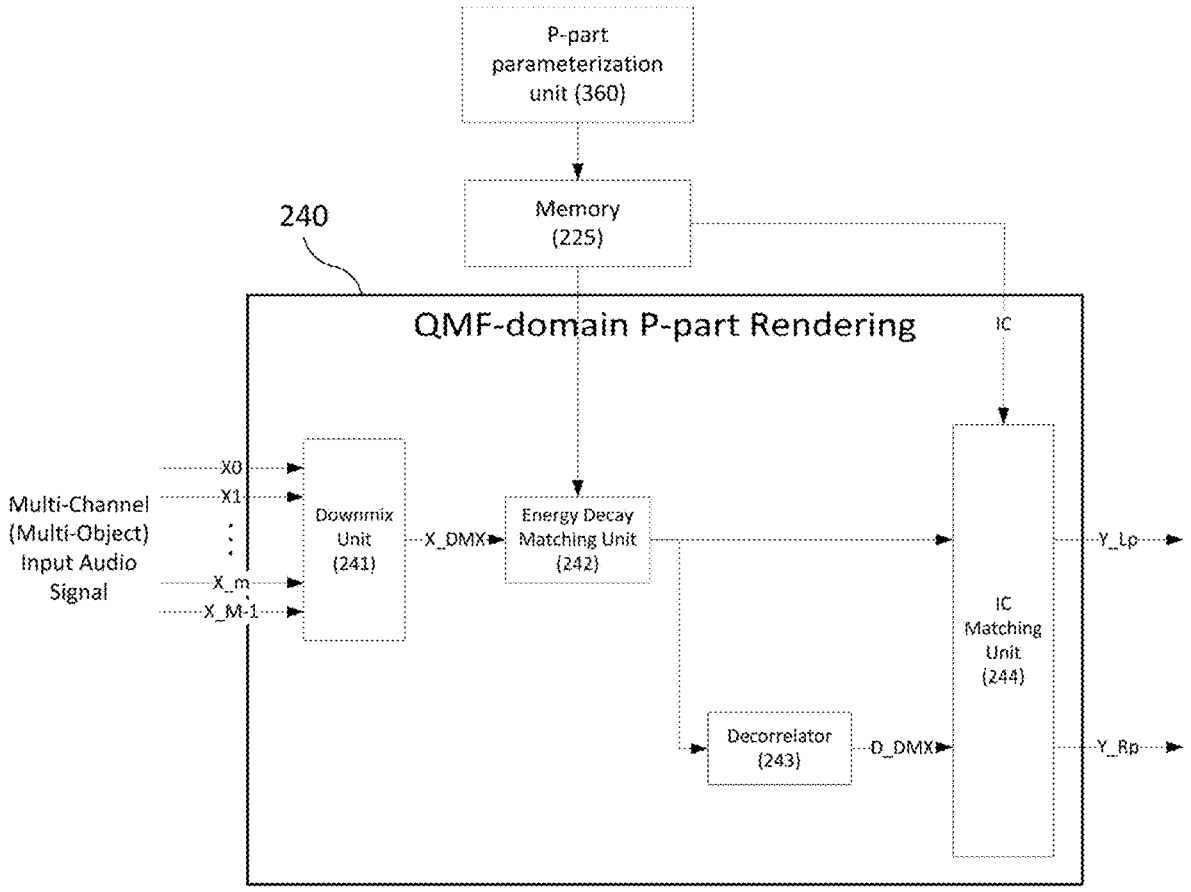
FIG. 11 is a diagram illustrating various exemplary embodiments of a P-part rendering unit of the present invention.

FIG. 11 illustrates a late reverberation generating unit 240 according to an exemplary embodiment of the present invention. According to the exemplary embodiment of FIG. 11, the late reverberation generating unit 240 may include a downmix unit 241, an energy decay matching unit 242, a decorrelator 243, and an IC matching unit 244. Further, a P-part parameterization unit 360 of the BRIR parameterization unit generates downmix subband filter coefficients and an IC value and transfers the generated downmix subband filter coefficients and IC value to the binaural rendering unit, for processing of the late reverberation generating unit 240.

First, the downmix unit 241 downmixes the multi-channel input signals X0, X1, . . . , X_M−1 for each subband to generate a mono downmix signal (that is, a mono subband signal) X_DMX. The energy decay matching unit 242 reflects energy decay for the generated mono downmix signal. In this case, the downmix subband filter coefficients for each subband may be used to reflect the energy decay. The downmix subband filter coefficients may be obtained from the P-part parameterization unit 360 and are generated by combination of rear subband filter coefficients of the respective channels of the corresponding subband. For example, the downmix subband filter coefficients may be obtained by taking a root of an average of square amplitude responses of the rear subband filter coefficients of the respective channels with respect to the corresponding subband. Accordingly, the downmix subband filter coefficients reflect an energy reduction characteristic of the late reverberation part for the corresponding subband signal. The downmix subband filter coefficients may include subband filter coefficients which are downmixed to mono or stereo according to the exemplary embodiment and be directly received from the P-part parameterization unit 360 or obtained from values prestored in the memory 225.

Next, the decorrelator 243 generates the decorrelation signal D_DMX of the mono downmix signal to which the energy decay is reflected. The decorrelator 243 as a kind of preprocessor for adjusting coherence between both ears may adopt a phase randomizer and change a phase of an input signal by 90° wise for efficiency of the computational complexity.

Meanwhile, the binaural rendering unit may store the IC value received from the P-part parameterization unit 360 in the memory 255 and transfers the received IC value to the IC matching unit 244. The IC matching unit 244 may directly receive the IC value from the P-part parameterization unit 360 or otherwise obtain the IC value prestored in the memory 225. The IC matching unit 244 performs weighted summing of the mono downmix signal to which the energy decay is reflected and the decorrelation signal by referring to the IC value and generates the 2-channel left and right output signals Y_Lp and Y_Rp through the weighted summing. When an original channel signal is represented by X, a decorrelation channel signal is represented by D, and an IC of the corresponding subband is represented by $\phi$, left and right channel signals X_L and X_R which are subjected to IC matching may be expressed like an equation given below.

$$X_L=\mathrm{sqrt}((1+\phi)/2)X\pm\mathrm{sqrt}((1-\phi)/2)D$$

$$X_R=\mathrm{sqrt}((1+\phi)/2)X\mp\mathrm{sqrt}((1-\phi)/2)D \qquad \text{[Equation 3]}$$

(double signs in same order)

<QTDL Processing of High-Frequency Bands>

Next, various exemplary embodiments of the QTDL processing of the present invention will be described with reference to FIGS. 12 and 13. That is, various exemplary embodiments of the QTDL processing unit 250 of FIG. 2, which performs the QTDL processing in the QMF domain, will be described with reference to FIGS. 12 and 13. In the exemplary embodiments of FIGS. 12 and 13, it is assumed that the multi-channel input signals are received as the subband signals of the QMF domain. Therefore, in the exemplary embodiments of FIGS. 12 and 13, a tap-delay line filter and a one-tap-delay line filter may perform processing for each QMF subband. Further, the QTDL processing may be performed only with respect to input signals of high-frequency bands, which are classified based on the predetermined constant or the predetermined frequency band, as described above. When the spectral band replication (SBR) is applied to the input audio signal, the high-frequency bands may correspond to the SBR bands. In the exemplary embodiments of FIGS. 12 and 13, detailed description of parts duplicated with the exemplary embodiments of the previous drawings will be omitted.

The spectral band replication (SBR) used for efficient encoding of the high-frequency bands is a tool for securing a bandwidth as large as an original signal by re-extending a bandwidth which is narrowed by throwing out signals of the high-frequency bands in low-bit rate encoding. In this case, the high-frequency bands are generated by using information of low-frequency bands, which are encoded and transmitted, and additional information of the high-frequency band signals transmitted by the encoder. However, distortion may occur in a high-frequency component generated by using the SBR due to generation of inaccurate harmonic. Further, the SBR bands are the high-frequency bands, and as described above, reverberation times of the corresponding frequency bands are very short. That is, the BRIR subband filters of the SBR bands have small effective information and a high decay rate. Accordingly, in BRIR rendering for the high-frequency bands corresponding to the SBR bands, performing the rendering by using a small number of effective taps may be still more effective in terms of a computational complexity to the sound quality than performing the convolution.

Figure 12:
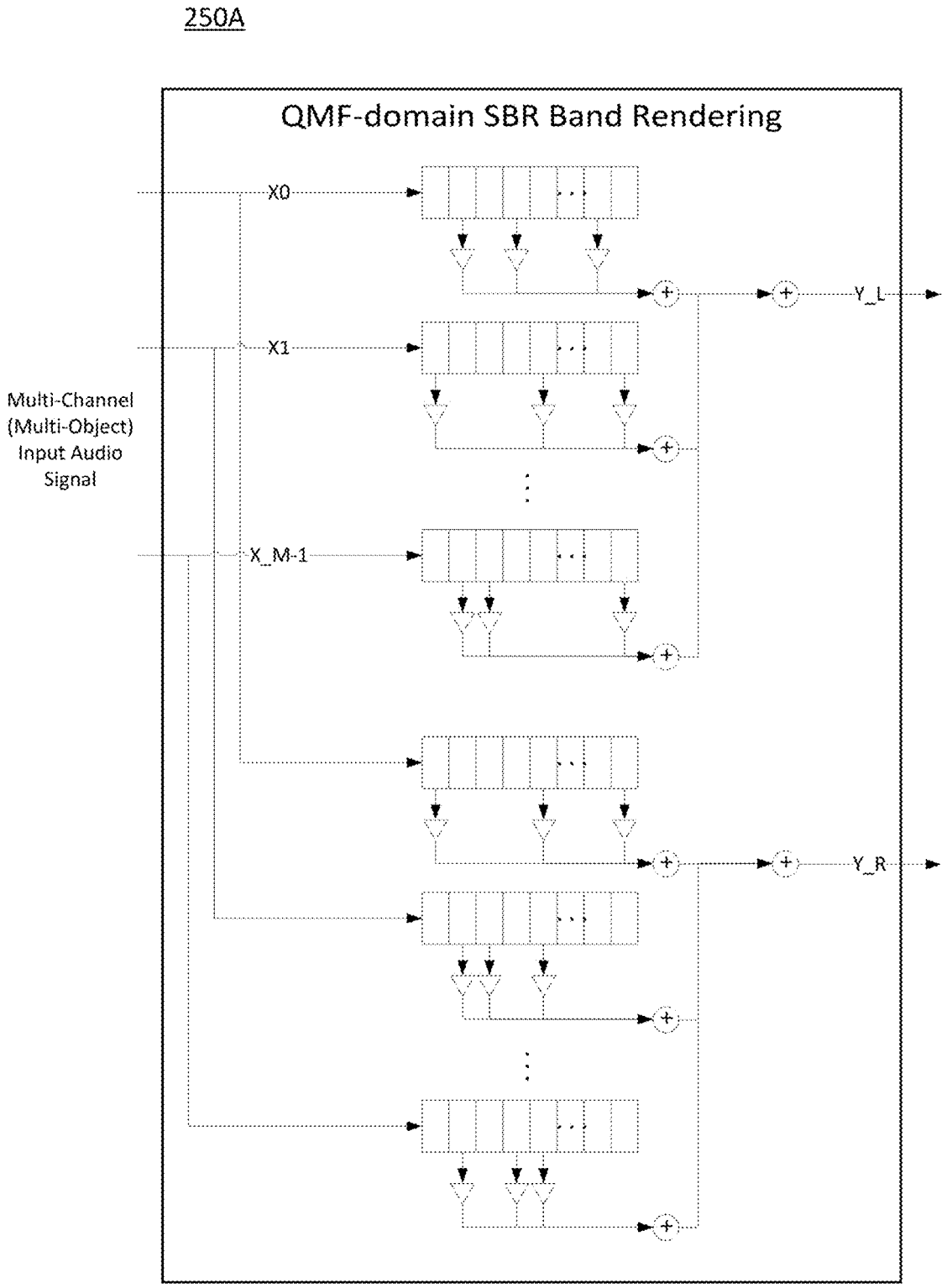
FIGS. 12 and 13 are diagrams illustrating various exemplary embodiments of QTDL processing of the present invention.

FIG. 12 illustrates a QTDL processing unit 250A according to an exemplary embodiment of the present invention. According to the exemplary embodiment of FIG. 12, the QTDL processing unit 250A performs filtering for each subband for the multi-channel input signals X0, X1, . . . , X_M−1 by using the tap-delay line filter. The tap-delay line filter performs convolution of only a small number of predetermined taps with respect to each channel signal. In this case, the small number of taps used at this time may be determined based on a parameter directly extracted from the BRIR subband filter coefficients corresponding to the relevant subband signal. The parameter includes delay information for each tap, which is to be used for the tap-delay line filter, and gain information corresponding thereto.

The number of taps used for the tap-delay line filter may be determined by the complexity-quality control. The QTDL processing unit 250A receives parameter set(s) (gain information and delay information), which corresponds to the relevant number of tap(s) for each channel and for each subband, from the BRIR parameterization unit, based on the determined number of taps. In this case, the received parameter set may be extracted from the BRIR subband filter coefficients corresponding to the relevant subband signal and determined according to various exemplary embodiments. For example, parameter set(s) for respective extracted peaks as many as the determined number of taps among a plurality of peaks of the corresponding BRIR subband filter coefficients in the order of an absolute value, the order of the value of a real part, or the order of the value of an imaginary part may be received. In this case, delay information of each parameter indicates positional information of the corresponding peak and has a sample based integer value in the QMF domain. Further, the gain information may be determined based on the total power of the corresponding BRIR subband filter coefficients, the size of the peak corresponding to the delay information, and the like. In this case, as the gain information, a weighted value of the corresponding peak after energy compensation for whole subband filter coefficients is performed may be used as well as the corresponding peak value itself in the subband filter coefficients. The gain information is obtained by using both a real-number of the weighted value and an imaginary-number of the weighted value for the corresponding peak to thereby have the complex value.

The plurality of channels signals filtered by the tap-delay line filter is summed to the 2-channel left and right output signals Y_L and Y_R for each subband. Meanwhile, the parameter used in each tap-delay line filter of the QTDL processing unit 250A may be stored in the memory during an initialization process for the binaural rendering and the QTDL processing may be performed without an additional operation for extracting the parameter.

Figure 13:
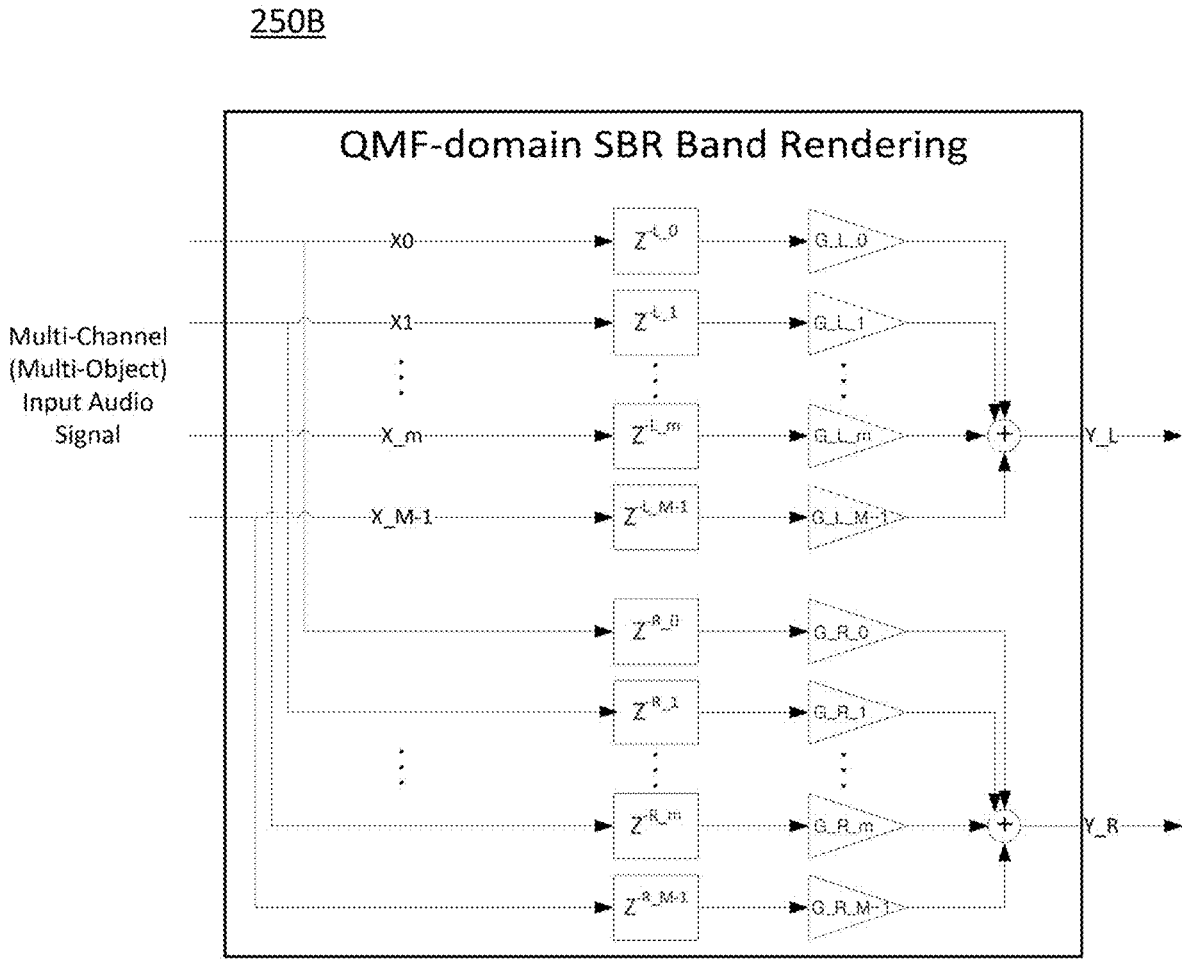

FIG. 13 illustrates a QTDL processing unit 250B according to another exemplary embodiment of the present invention. According to the exemplary embodiment of FIG. 13, the QTDL processing unit 250B performs filtering for each subband for the multi-channel input signals X0, X1, . . . , X_M−1 by using the one-tap-delay line filter. It may be appreciated that the one-tap-delay line filter performs the convolution only in one tap with respect to each channel signal. In this case, the used tap may be determined based on a parameter(s) directly extracted from the BRIR subband filter coefficients corresponding to the relevant subband signal. The parameter(s) includes delay information extracted from the BRIR subband filter coefficients and gain information corresponding thereto.

In FIG. 13, L_0, L_1, . . . L_M−1 represent delays for the BRIRs with respect to M channels-left ear, respectively, and R_0, R_1, . . . , R_M−1 represent delays for the BRIRs with respect to M channels-right ear, respectively. In this case, the delay information represents positional information for the maximum peak in the order of an absolution value, the value of a real part, or the value of an imaginary part among the BRIR subband filter coefficients. Further, in FIG. 13, G_L_0, G_L_1, . . . , G_L_M−1 represent gains corresponding to respective delay information of the left channel and G_R_0, G_R_1, . . . , G_R_M−1 represent gains corresponding to the respective delay information of the right channels, respectively. As described, each gain information may be determined based on the total power of the corresponding BRIR subband filter coefficients, the size of the peak corresponding to the delay information, and the like. In this case, as the gain information, the weighted value of the corresponding peak after energy compensation for whole subband filter coefficients may be used as well as the corresponding peak value itself in the subband filter coefficients. The gain information is obtained by using both the real-number of the weighted value and the imaginary-number of the weighted value for the corresponding peak.

As described above, the plurality of channel signals filtered by the one-tap-delay line filter are summed with the 2-channel left and right output signals Y_L and Y_R for each subband. Further, the parameter used in each one-tap-delay line filter of the QTDL processing unit 250B may be stored in the memory during the initialization process for the binaural rendering and the QTDL processing may be performed without an additional operation for extracting the parameter.

<BRIR Parameterization in Detail>

Figure 14:
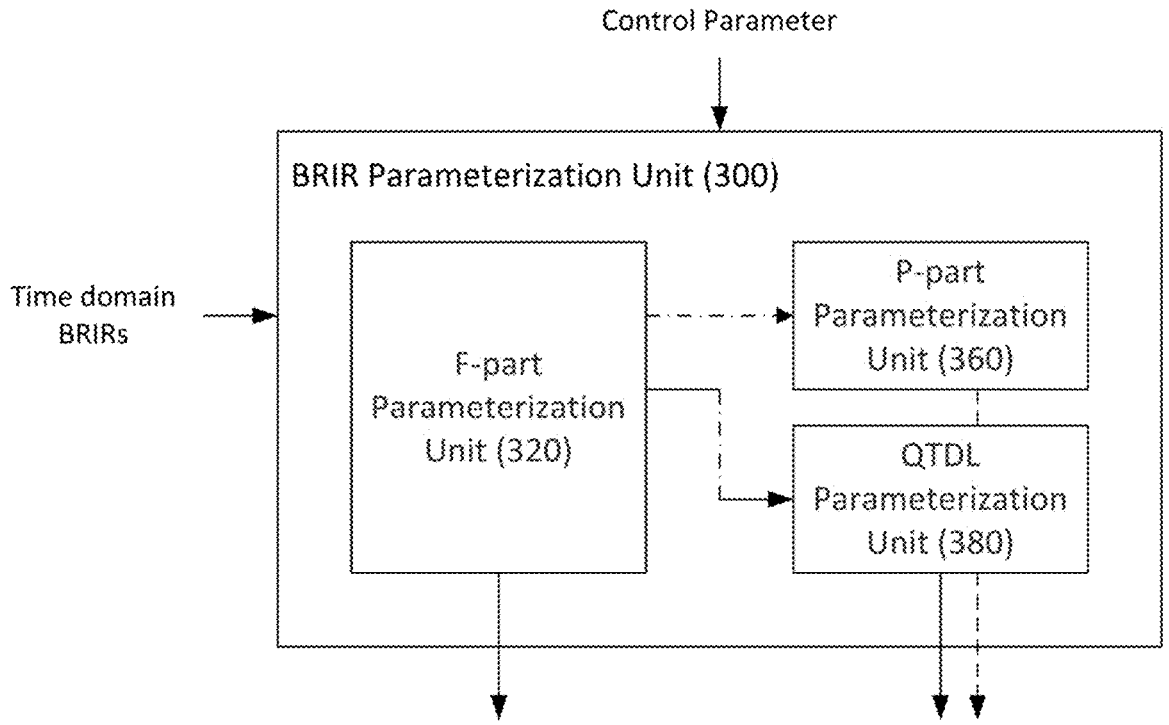
FIG. 14 is a block diagram illustrating respective components of a BRIR parameterization unit of an embodiment of the present invention.

FIG. 14 is a block diagram illustrating respective components of a BRIR parameterization unit according to an exemplary embodiment of the present invention. As illustrated in FIG. 14, the BRIR parameterization unit 300 may include an F-part parameterization unit 320, a P-part parameterization unit 360, and a QTDL parameterization unit 380. The BRIR parameterization unit 300 receives a BRIR filter set of the time domain as an input and each sub unit of the BRIR parameterization unit 300 generate various parameters for the binaural rendering by using the received BRIR filter set. According to the exemplary embodiment, the BRIR parameterization unit 300 may additionally receive the control parameter and generate the parameter based on the receive control parameter.

First, the F-part parameterization unit 320 generates truncated subband filter coefficients required for variable order filtering in frequency domain (VOFF) and the resulting auxiliary parameters. For example, the F-part parameterization unit 320 calculates frequency band-specific reverberation time information, filter order information, and the like which are used for generating the truncated subband filter coefficients and determines the size of a block for performing block-wise fast Fourier transform for the truncated subband filter coefficients. Some parameters generated by the F-part parameterization unit 320 may be transmitted to the P-part parameterization unit 360 and the QTDL parameterization unit 380. In this case, the transferred parameters are not limited to a final output value of the F-part parameterization unit 320 and may include a parameter generated in the meantime according to processing of the F-part parameterization unit 320, that is, the truncated BRIR filter coefficients of the time domain, and the like.

The P-part parameterization unit 360 generates a parameter required for P-part rendering, that is, late reverberation generation. For example, the P-part parameterization unit 360 may generate the downmix subband filter coefficients, the IC value, and the like. Further, the QTDL parameterization unit 380 generates a parameter for QTDL processing. In more detail, the QTDL parameterization unit 380 receives the subband filter coefficients from the F-part parameterization unit 320 and generates delay information and gain information in each subband by using the received subband filter coefficients. In this case, the QTDL parameterization unit 380 may receive information Kproc of a maximum frequency band for performing the binaural rendering and information Kconv of a frequency band for performing the convolution as the control parameters and generate the delay information and the gain information for each frequency band of a subband group having Kproc and Kconv as boundaries. According to the exemplary embodiment, the QTDL parameterization unit 380 may be provided as a component included in the F-part parameterization unit 320.

The parameters generated in the F-part parameterization unit 320, the P-part parameterization unit 360, and the QTDL parameterization unit 380, respectively are transmitted to the binaural rendering unit (not illustrated). According to the exemplary embodiment, the P-part parameterization unit 360 and the QTDL parameterization unit 380 may determine whether the parameters are generated according to whether the P-part rendering and the QTDL processing are performed in the binaural rendering unit, respectively. When at least one of the P-part rendering and the QTDL processing is not performed in the binaural rendering unit, the P-part parameterization unit 360 and the QTDL parameterization unit 380 corresponding thereto may not generate the parameters or not transmit the generated parameters to the binaural rendering unit.

Figure 15:
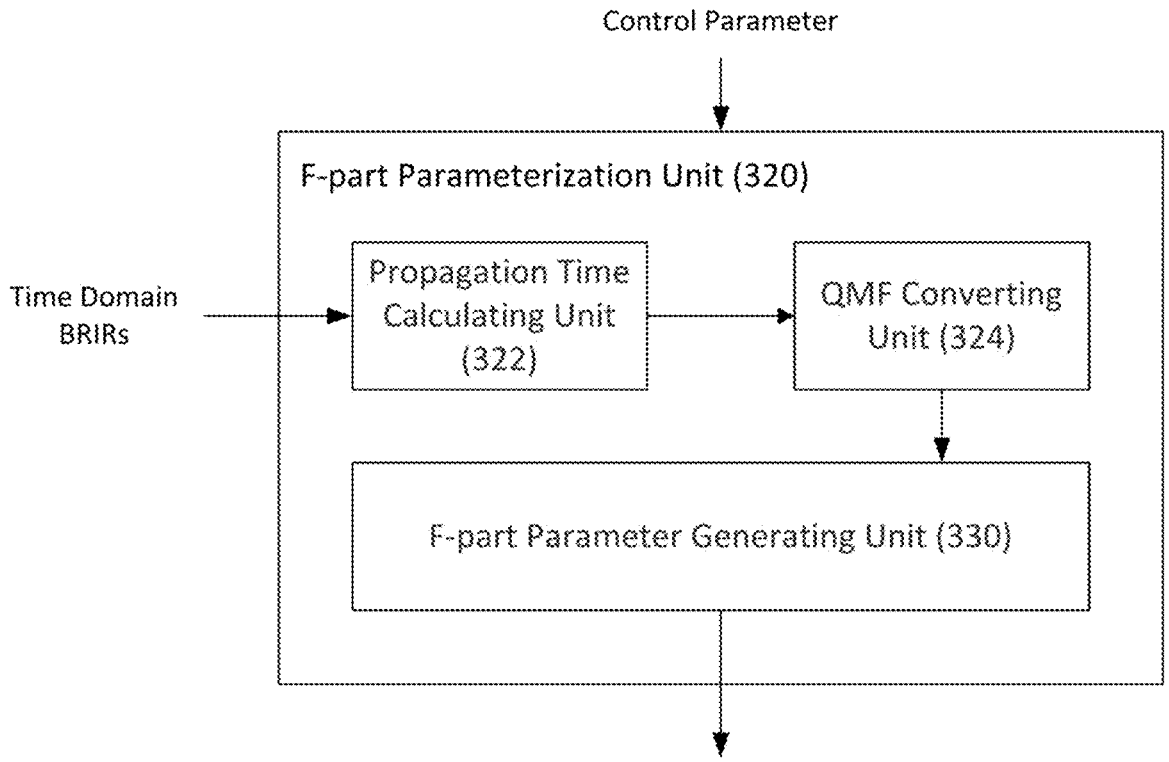
FIG. 15 is a block diagram illustrating respective components of an F-part parameterization unit of an embodiment of the present invention.

FIG. 15 is a block diagram illustrating respective components of an F-part parameterization unit of the present invention. As illustrated in FIG. 15, the F-part parameterization unit 320 may include a propagation time calculating unit 322, a QMF converting unit 324, and an F-part parameter generating unit 330. The F-part parameterization unit 320 performs a process of generating the truncated subband filter coefficients for F-part rendering by using the received time domain BRIR filter coefficients.

First, the propagation time calculating unit 322 calculates propagation time information of the time domain BRIR filter coefficients and truncates the time domain BRIF filter coefficients based on the calculated propagation time information. Herein, the propagation time information represents a time from an initial sample to direct sound of the BRIR filter coefficients. The propagation time calculating unit 322 may truncate a part corresponding to the calculated propagation time from the time domain BRIR filter coefficients and remove the truncated part.

Various methods may be used for estimating the propagation time of the BRIR filter coefficients. According to the exemplary embodiment, the propagation time may be estimated based on first point information where an energy value larger than a threshold which is in proportion to a maximum peak value of the BRIR filter coefficients is shown. In this case, since all distances from respective channels of multi-channel inputs up to a listener are different from each other, the propagation time may vary for each channel. However, the truncating lengths of the propagation time of all channels need to be the same as each other in order to perform the convolution by using the BRIR filter coefficients in which the propagation time is truncated at the time of performing the binaural rendering and compensate a final signal in which the binaural rendering is performed with a delay. Further, when the truncating is performed by applying the same propagation time information to each channel, error occurrence probabilities in the individual channels may be reduced.

In order to calculate the propagation time information according to the exemplary embodiment of the present invention, frame energy E(k) for a frame wise index k may be first defined. When the time domain BRIR filter coefficient for an input channel index m, an output left/right channel index i, and a time slot index v of the time domain is $\tilde{h}_{i,m}^{v}$, the frame energy E(k) in a k-th frame may be calculated by an equation given below.

$$E(k) = \frac{1}{2N_{BRIR}} \sum_{m=1}^{N_{BRIR}} \sum_{i=0}^{1} \frac{1}{L_{frm}} \sum_{n=0}^{L_{frm}-1} \tilde{h}_{i,m}^{kN_{hop}+n} \quad \text{[Equation 4]}$$

Where, $N_{BRIR}$ represents the total number of BRIR filters, $N_{hop}$ represents a predetermined hop size, and $L_{frm}$ represents a frame size. That is, the frame energy E(k) may be calculated as an average value of the frame energy for each channel with respect to the same time interval.

The propagation time pt may be calculated through an equation given below by using the defined frame energy E(k).

$$pt = \frac{L_{frm}}{2} + N_{hop} * \min\left[\arg_k\left(\frac{E(k)}{\max(E)} > -60\text{ dB}\right)\right] \quad \text{[Equation 5]}$$

That is, the propagation time calculating unit 322 measures the frame energy by shifting a predetermined hop wise and identifies the first frame in which the frame energy is larger than a predetermined threshold. In this case, the propagation time may be determined as an intermediate point of the identified first frame. Meanwhile, in Equation 5, it is described that the threshold is set to a value which is lower than maximum frame energy by 60 dB, but the present invention is not limited thereto and the threshold may be set to a value which is in proportion to the maximum frame energy or a value which is different from the maximum frame energy by a predetermined value.

Meanwhile, the hop size $N_{hop}$ and the frame size $L_{frm}$ may vary based on whether the input BRIR filter coefficients are head related impulse response (HRIR) filter coefficients. In this case, information flag_HRIR indicating whether the input BRIR filter coefficients are the HRIR filter coefficients may be received from the outside or estimated by using the length of the time domain BRIR filter coefficients. In general, a boundary of an early reflection sound part and a late reverberation part is known as 80 ms. Therefore, when the length of the time domain BRIR filter coefficients is 80 ms or less, the corresponding BRIR filter coefficients are determined as the HRIR filter coefficients (flag_HRIR=1) and when the length of the time domain BRIR filter coefficients is more than 80 ms, it may be determined that the corresponding BRIR filter coefficients are not the HRIR filter coefficients (flag_HRIR=0). The hop size $N_{hop}$ and the frame size $L_{frm}$ when it is determined that the input BRIR filter coefficients are the HRIR filter coefficients (flag_HRIR=1) may be set to smaller values than those when it is determined that the corresponding BRIR filter coefficients are not the HRIR filter coefficients (flag_HRIR=0). For example, in the case of flag_HRIR=0, the hop size $N_{hop}$ and the frame size $L_{frm}$ may be set to 8 and 32 samples, respectively and in the case of flag_HRIR=1, the hop size $N_{hop}$ and the frame size $L_{frm}$ may be set to 1 and 8 sample(s), respectively.

According to the exemplary embodiment of the present invention, the propagation time calculating unit 322 may truncate the time domain BRIR filter coefficients based on the calculated propagation time information and transfer the truncated BRIR filter coefficients to the QMF converting unit 324. Herein, the truncated BRIR filter coefficients indicates remaining filter coefficients after truncating and removing the part corresponding to the propagation time from the original BRIR filter coefficients. The propagation time calculating unit 322 truncates the time domain BRIR filter coefficients for each input channel and each output left/right channel and transfers the truncated time domain BRIR filter coefficients to the QMF converting unit 324.

The QMF converting unit 324 performs conversion of the input BRIR filter coefficients between the time domain and the QMF domain. That is, the QMF converting unit 324 receives the truncated BRIR filter coefficients of the time domain and converts the received BRIR filter coefficients into a plurality of subband filter coefficients corresponding to a plurality of frequency bands, respectively. The converted subband filter coefficients are transferred to the F-part parameter generating unit 330 and the F-part parameter generating unit 330 generates the truncated subband filter coefficients by using the received subband filter coefficients. When the QMF domain BRIR filter coefficients instead of the time domain BRIR filter coefficients are received as the input of the F-part parameterization unit 320, the received QMF domain BRIR filter coefficients may bypass the QMF converting unit 324. Further, according to another exemplary embodiment, when the input filter coefficients are the QMF domain BRIR filter coefficients, the QMF converting unit 324 may be omitted in the F-part parameterization unit 320.

Figure 16:
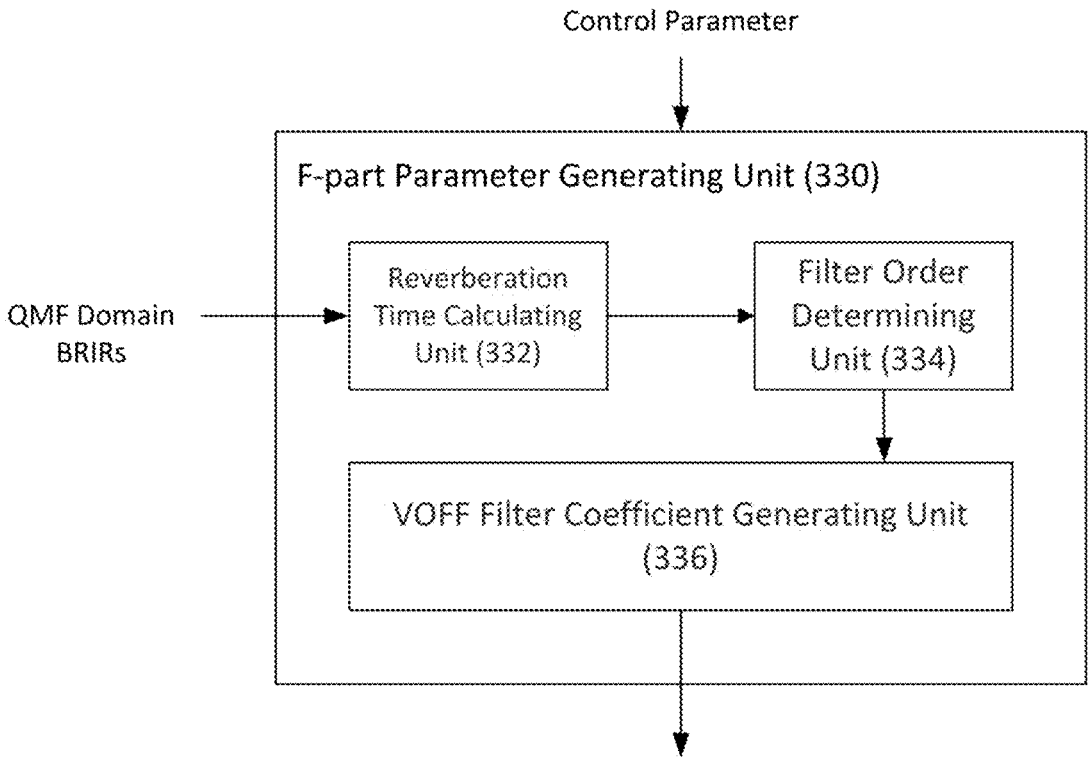
FIG. 16 is a block diagram illustrating a detailed configuration of an F-part parameter generating unit of an embodiment of the present invention.

FIG. 16 is a block diagram illustrating a detailed configuration of the F-part parameter generating unit of FIG. 15. As illustrated in FIG. 16, the F-part parameter generating unit 330 may include a reverberation time calculating unit 332, a filter order determining unit 334, and a VOFF filter coefficient generating unit 336. The F-part parameter generating unit 330 may receive the QMF domain subband filter coefficients from the QMF converting unit 324 of FIG. 15. Further, the control parameters including the maximum frequency band information Kproc performing the binaural rendering, the frequency band information Kconv performing the convolution, predetermined maximum FFT size information, and the like may be input into the F-part parameter generating unit 330.

First, the reverberation time calculating unit 332 obtains the reverberation time information by using the received subband filter coefficients. The obtained reverberation time information may be transferred to the filter order determining unit 334 and used for determining the filter order of the corresponding subband. Meanwhile, since a bias or a deviation may be present in the reverberation time information according to a measurement environment, a unified value may be used by using a mutual relationship with another channel. According to the exemplary embodiment, the reverberation time calculating unit 332 generates average reverberation time information of each subband and transfers the generated average reverberation time information to the filter order determining unit 334. When the reverberation time information of the subband filter coefficients for the input channel index m, the output left/right channel index i, and the subband index k is RT(k, m, i), the average reverberation time information $RT^k$ of the subband k may be calculated through an equation given below.

$$RT^k = \frac{1}{2N_{BRIR}} \sum_{i=0}^{1} \sum_{m=0}^{N_{BRIR}-1} RT(k, m, i) \quad \text{[Equation 6]}$$

Where, $N_{BRIR}$ represents the total number of BRIR filters.

That is, the reverberation time calculating unit 332 extracts the reverberation time information RT(k, m, i) from each subband filter coefficients corresponding to the multi-channel input and obtains an average value (that is, the average reverberation time information $RT^k$) of the reverberation time information RT(k, m, i) of each channel extracted with respect to the same subband. The obtained average reverberation time information $RT^k$ may be transferred to the filter order determining unit 334 and the filter order determining unit 334 may determine a single filter order applied to the corresponding subband by using the transferred average reverberation time information $RT^k$. In this case, the obtained average reverberation time information may include RT20 and according to the exemplary embodiment, other reverberation time information, that is to say, RT30, RT60, and the like may be obtained as well. Meanwhile, according to another exemplary embodiment of the present invention, the reverberation time calculating unit 332 may transfer a maximum value and/or a minimum value of the reverberation time information of each channel extracted with respect to the same subband to the filter order determining unit 334 as representative reverberation time information of the corresponding subband.

Next, the filter order determining unit 334 determines the filter order of the corresponding subband based on the obtained reverberation time information. As described above, the reverberation time information obtained by the filter order determining unit 334 may be the average reverberation time information of the corresponding subband and according to exemplary embodiment, the representative reverberation time information with the maximum value and/or the minimum value of the reverberation time information of each channel may be obtained instead. The filter order may be used for determining the length of the truncated subband filter coefficients for the binaural rendering of the corresponding subband.

When the average reverberation time information in the subband k is $RT^k$, the filter order information $N_{Filter}[k]$ of the corresponding subband may be obtained through an equation given below.

$$N_{Filter}[k]=2^{\lfloor \log_2 RT^k+0.5 \rfloor} \quad \text{[Equation 7]}$$

That is, the filter order information may be determined as a value of power of 2 using a log-scaled approximated integer value of the average reverberation time information of the corresponding subband as an index. In other words, the filter order information may be determined as a value of power of 2 using a round off value, a round up value, or a round down value of the average reverberation time information of the corresponding subband in the log scale as the index. When an original length of the corresponding subband filter coefficients, that is, a length up to the last time slot $n_{end}$ is smaller than the value determined in Equation 7, the filter order information may be substituted with the original length value $n_{end}$ of the subband filter coefficients. That is, the filter order information may be determined as a smaller value of a reference truncation length determined by Equation 7 and the original length of the subband filter coefficients.

Meanwhile, the decay of the energy depending on the frequency may be linearly approximated in the log scale. Therefore, when a curve fitting method is used, optimized filter order information of each subband may be determined. According to the exemplary embodiment of the present invention, the filter order determining unit 334 may obtain the filter order information by using a polynomial curve fitting method. To this end, the filter order determining unit 334 may obtain at least one coefficient for curve fitting of the average reverberation time information. For example, the filter order determining unit 334 performs curve fitting of the average reverberation time information for each subband by a linear equation in the log scale and obtain a slope value 'a' and a fragment value 'b' of the corresponding linear equation.

The curve-fitted filter order information $N'_{Filter}[k]$ in the subband k may be obtained through an equation given below by using the obtained coefficients.

$$N'_{Filter}[k]=2^{\lfloor bk+a+0.5 \rfloor} \quad \text{[Equation 8]}$$

That is, the curve-fitted filter order information may be determined as a value of power of 2 using an approximated integer value of a polynomial curve-fitted value of the average reverberation time information of the corresponding subband as the index. In other words, the curve-fitted filter order information may be determined as a value of power of 2 using a round off value, a round up value, or a round down value of the polynomial curve-fitted value of the average reverberation time information of the corresponding subband as the index. When the original length of the corresponding subband filter coefficients, that is, the length up to the last time slot $n_{end}$ is smaller than the value determined in Equation 8, the filter order information may be substituted with the original length value $n_{end}$ of the subband filter coefficients. That is, the filter order information may be determined as a smaller value of the reference truncation length determined by Equation 8 and the original length of the subband filter coefficients.

According to the exemplary embodiment of the present invention, based on whether proto-type BRIR filter coefficients, that is, the BRIR filter coefficients of the time domain are the HRIR filter coefficients (flag_HRIR), the filter order information may be obtained by using any one of Equation 7 and Equation 8. As described above, a value of flag_HRIR may be determined based on whether the length of the proto-type BRIR filter coefficients is more than a predetermined value. When the length of the proto-type BRIR filter coefficients is more than the predetermined value (that is, flag_HRIR=0), the filter order information may be determined as the curve-fitted value according to Equation 8 given above. However, when the length of the proto-type BRIR filter coefficients is not more than the predetermined value (that is, flag_HRIR=1), the filter order information may be determined as a non-curve-fitted value according to Equation 7 given above. That is, the filter order information may be determined based on the average reverberation time information of the corresponding subband without performing the curve fitting. The reason is that since the HRIR is not influenced by a room, a tendency of the energy decay is not apparent in the HRIR.

Meanwhile, according to the exemplary embodiment of the present invention, when the filter order information for a 0-th subband (that is, subband index 0) is obtained, the average reverberation time information in which the curve fitting is not performed may be used. The reason is that the reverberation time of the 0-th subband may have a different tendency from the reverberation time of another subband due to an influence of a room mode, and the like. Therefore, according to the exemplary embodiment of the present invention, the curve-fitted filter order information according to Equation 8 may be used only in the case of flag_HRIR=0 and in the subband in which the index is not 0.

The filter order information of each subband determined according to the exemplary embodiment given above is transferred to the VOFF filter coefficient generating unit 336. The VOFF filter coefficient generating unit 336 generates the truncated subband filter coefficients based on the obtained filter order information. According to the exemplary embodiment of the present invention, the truncated subband filter coefficients may be constituted by at least one FFT filter coefficient in which the fast Fourier transform (FFT) is performed by a predetermined block wise for block-wise fast convolution. The VOFF filter coefficient generating unit 336 may generate the FFT filter coefficients for the block-wise fast convolution as described below with reference to FIGS. 17 and 18.

According to the exemplary embodiment of the present invention, a predetermined block-wise fast convolution may be performed for optimal binaural rendering in terms of efficiency and performance. A fast convolution based on FFT has a characteristic in which as the size of the FFT increases, a calculation amount decreases, but an overall processing delay increases and a memory usage increases. When a BRIR having a length of 1 second is subjected to the fast convolution with an FFT size having a length twice the corresponding length, it is efficient in terms of the calculation amount, but a delay corresponding to 1 second occurs and a buffer and a processing memory corresponding thereto are required. An audio signal processing method having a long delay time is not suitable for an application for real-time data processing. Since a frame is a minimum unit by which decoding can be performed by the audio signal processing apparatus, the block-wise fast convolution is preferably performed with a size corresponding to the frame unit even in the binaural rendering.

Figure 17:
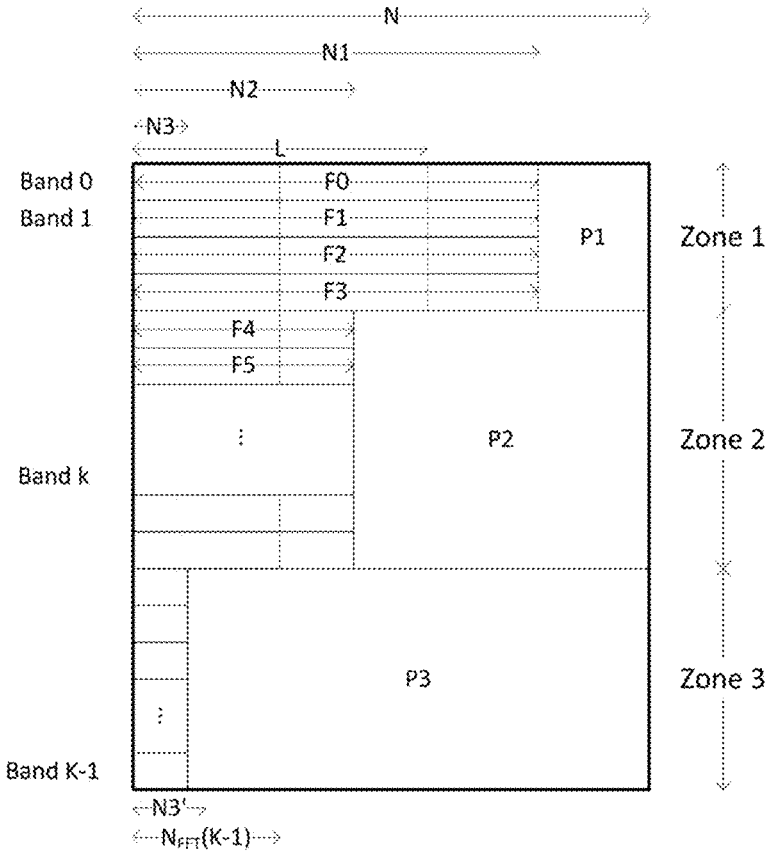
FIGS. 17 and 18 are diagrams illustrating an exemplary embodiment of a method for generating an FFT filter coefficient for block-wise fast convolution.

FIG. 17 illustrates an exemplary embodiment of FFT filter coefficients generating method for the block-wise fast convolution. Similarly to the aforementioned exemplary embodiment, in the exemplary embodiment of FIG. 17, the proto-type FIR filter is converted into K subband filters, and Fk represents a truncated subband filter of a subband k. The respective subbands Band 0 to Band K-1 may represent subbands in the frequency domain, that is, QMF subbands. In the QMF domain, a total of 64 subbands may be used, but the present invention is not limited thereto. Further, N represents the length (the number of taps) of the original subband filter and the lengths of the truncated subband filters are represented by N1, N2, and N3, respectively. That is, the length of the truncated subband filter coefficients of subband k included in Zone 1 has the N1 value, the length of the truncated subband filter coefficients of subband k included in Zone 2 has the N2 value, and the length of the truncated subband filter coefficients of subband k included in Zone 3 has the N3 value. In this case, the lengths N, N1, N2, and N3 represent the number of taps in a downsampled QMF domain. As described above, the length of the truncated subband filter may be independently determined for each of the subband groups Zone 1, Zone 2, and Zone 3 as illustrated in FIG. 17, or otherwise determined independently for each subband.

Referring to FIG. 17, the VOFF filter coefficient generating unit 336 of the present invention performs fast Fourier transform of the truncated subband filter coefficients by a predetermined block size in the corresponding subband (alternatively, subband group) to generate an FFT filter coefficients. In this case, the length $N_{FFT}(k)$ of the predetermined block in each subband k is determined based on a predetermined maximum FFT size L. In more detail, the length $N_{FFT}(k)$ of the predetermined block in subband k may be expressed by the following equation.

$$N_{FFT}(k)=\min(L,\ 2N_k) \qquad \text{[Equation 9]}$$

Where, L represents a predetermined maximum FFT size and N_k represents a reference filter length of the truncated subband filter coefficients.

That is, the length $N_{FFT}(k)$ of the predetermined block may be determined as a smaller value between a value twice the reference filter length N_k of the truncated subband filter coefficients and the predetermined maximum FFT size L. When the value twice the reference filter length N_k of the truncated subband filter coefficients is equal to or larger than (alternatively, larger than) the maximum FFT size L like Zone 1 and Zone 2 of FIG. 17, the length $N_{FFT}(k)$ of the predetermined block is determined as the maximum FFT size L. However, when the value twice the reference filter length N_k of the truncated subband filter coefficients is smaller than (equal to or smaller than) the maximum FFT size L like Zone 3 of FIG. 17, the length $N_{FFT}(k)$ of the predetermined block is determined as the value twice the reference filter length N_k. As described below, since the truncated subband filter coefficients are extended to a double length through zero-padding and thereafter, subjected to the fast Fourier transform, the length $N_{FFT}(k)$ of the block for the fast Fourier transform may be determined based on a comparison result between the value twice the reference filter length N_k and the predetermined maximum FFT size L.

Herein, the reference filter length N_k represents any one of a true value and an approximate value of a filter order (that is, the length of the truncated subband filter coefficients) in the corresponding subband in a form of power of 2. That is, when the filter order of subband k has the form of power of 2, the corresponding filter order is used as the reference filter length N_k in subband k and when the filter order of subband k does not have the form of power of 2 (e.g., $n_{end}$), a round off value, a round up value or a round down value of the corresponding filter order in the form of power of 2 is used as the reference filter length N_k. As an example, since N3 which is a filter order of subband K-1 of Zone 3 is not a power of 2 value, N3' which is an approximate value in the form of power of 2 may be used as a reference filter length N_K-1 of the corresponding subband. In this case, since a value twice the reference filter length N3' is smaller than the maximum FFT size L, a length $N_{FFT}$(k-1) of the predetermined block in subband K-1 may be set to the value twice N3'. Meanwhile, according to the exemplary embodiment of the present invention, both the length $N_{FFT}$ (k) of the predetermined block and the reference filter length N_k may be the power of 2 value.

As described above, when the block length $N_{FFT}(k)$ in each subband is determined, the VOFF filter coefficient generating unit 336 performs the fast Fourier transform of the truncated subband filter coefficients by the determined block size. In more detail, the VOFF filter coefficient generating unit 336 partitions the truncated subband filter coefficients by the half $N_{FFT}(k)/2$ of the predetermined block size. An area of a dotted line boundary of the F-part illustrated in FIG. 17 represents the subband filter coefficients partitioned by the half of the predetermined block size. Next, the BRIR parameterization unit generates temporary filter coefficients of the predetermined block size $N_{FFT}(k)$ by using the respective partitioned filter coefficients. In this case, a first half part of the temporary filter coefficients is constituted by the partitioned filter coefficients and a second half part is constituted by zero-padded values. Therefore, the temporary filter coefficients of the length $N_{FFT}(k)$ of the predetermined block is generated by using the filter coefficients of the half length $N_{FFT}(k)/2$ of the predetermined block. Next, the BRIR parameterization unit performs the fast Fourier transform of the generated temporary filter coefficients to generate FFT filter coefficients. The generated FFT filter coefficients may be used for a predetermined block wise fast convolution for an input audio signal.

As described above, according to the exemplary embodiment of the present invention, the VOFF filter coefficient generating unit 336 performs the fast Fourier transform of the truncated subband filter coefficients by the block size determined independently for each subband (alternatively, for each subband group) to generate the FFT filter coefficients. As a result, a fast convolution using different numbers of blocks for each subband (alternatively, for each subband group) may be performed. In this case, the number $N_{blk}(k)$ of blocks in subband k may satisfy the following equation.

$$N_k = N_{blk}(k) * N_{FFT}(k) \quad \text{[Equation 10]}$$

Where, $N_{blk}(k)$ is a natural number.

That is, the number $N_{blk}(k)$ of blocks in subband k may be determined as a value acquired by dividing the value twice the reference filter length N_k in the corresponding subband by the length $N_{FFT}(k)$ of the predetermined block.

Figure 18:
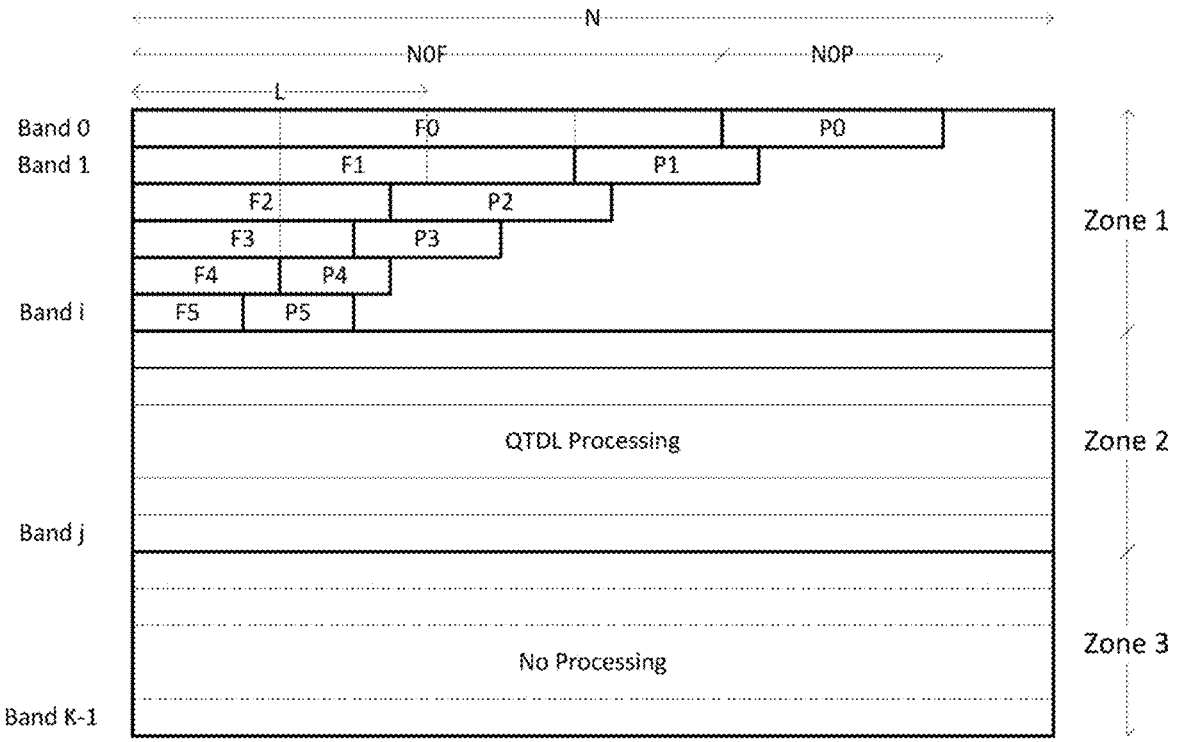

FIG. 18 illustrates another exemplary embodiment of FFT filter coefficients generating method for the block-wise fast convolution. In the exemplary embodiment of FIG. 18, a duplicative description of parts, which are the same as or correspond to the exemplary embodiment of FIG. 10 or 17, will be omitted.

Referring to FIG. 18, the plurality of subbands of the frequency domain may be classified into a first subband group Zone 1 having low frequencies and a second subband group Zone 2 having high frequencies based on a predetermined frequency band (QMF band i). Alternatively, the plurality of subbands may be classified into three subband groups, that is, the first subband group Zone 1, the second subband group Zone 2, and the third subband group Zone 3 based on a predetermined first frequency band (QMF band i) and a second frequency band (QMF band j). In this case, the F-part rendering using the block-wise fast convolution may be performed with respect to input subband signals of the first subband group, and the QTDL processing may be performed with respect to input subband signals of the second subband group. In addition, the rendering may not be performed with respect to the subband signals of the third subband group.

Therefore, according to the exemplary embodiment of the present invention, the generating process of the predetermined block-wise FFT filter coefficients may be restrictively performed with respect to the front subband filter Fk of the first subband group. Meanwhile, according to the exemplary embodiment, the P-part rendering for the subband signal of the first subband group may be performed by the late reverberation generating unit as described above. According to the exemplary embodiment of the present invention, the P-part rendering (that is, a late reverberation processing procedure) for an input audio signal may be performed based on whether the length of the proto-type BRIR filter coefficients is more than the predetermined value. As described above, whether the length of the proto-type BRIR filter coefficients is more than the predetermined value may be represented through a flag (that is, flag_BRIR) indicating that the length of the proto-type BRIR filter coefficients is more than the predetermined value. When the length of the proto-type BRIR filter coefficients is more than the predetermined value (flag_HRIR=0), the P-part rendering for the input audio signal may be performed. However, when the length of the proto-type BRIR filter coefficients is not more than the predetermined value (flag_HRIR=1), the P-part rendering for the input audio signal may not be performed.

When P-part rendering is not be performed, only the F-part rendering for each subband signal of the first subband group may be performed. However, a filter order (that is, a truncation point) of each subband designated for the F-part rendering may be smaller than a total length of the corresponding subband filter coefficients, and as a result, energy mismatch may occur. Therefore, in order to prevent the energy mismatch, according to the exemplary embodiment of the present invention, energy compensation for the truncated subband filter coefficients may be performed based on flag_HRIR information. That is, when the length of the proto-type BRIR filter coefficients is not more than the predetermined value (flag_HRIR=1), the filter coefficients of which the energy compensation is performed may be used as the truncated subband filter coefficients or each FFT filter coefficients constituting the same. In this case, the energy compensation may be performed by dividing the subband filter coefficients up to the truncation point based on the filter order information $N_{Filter}[k]$ by filter power up to the truncation point, and multiplying total filter power of the corresponding subband filter coefficients. The total filter power may be defined as the sum of the power for the filter coefficients from the initial sample up to the last sample need of the corresponding subband filter coefficients.

Meanwhile, according to another exemplary embodiment of the present invention, the filter orders of the respective subband filter coefficients may be set different from each other for each channel. For example, the filter order for front channels in which the input signals include more energy may be set to be higher than the filter order for rear channels in which the input signals include relatively smaller energy. Therefore, a resolution reflected after the binaural rendering is increased with respect to the front channels and the rendering may be performed with a low computational complexity with respect to the rear channels. Herein, classification of the front channels and the rear channels is not limited to channel names allocated to each channel of the multi-channel input signal and the respective channels may be classified into the front channels and the rear channels based on a predetermined spatial reference. Further, according to an additional exemplary embodiment of the present invention, the respective channels of the multi-channels may be classified into three or more channel groups based on the predetermined spatial reference and different filter orders may be used for each channel group. Alternatively, values to which different weighted values are applied based on positional information of the corresponding channel in a virtual reproduction space may be used for the filter orders of the subband filter coefficients corresponding to the respective channels.

Figure 19:
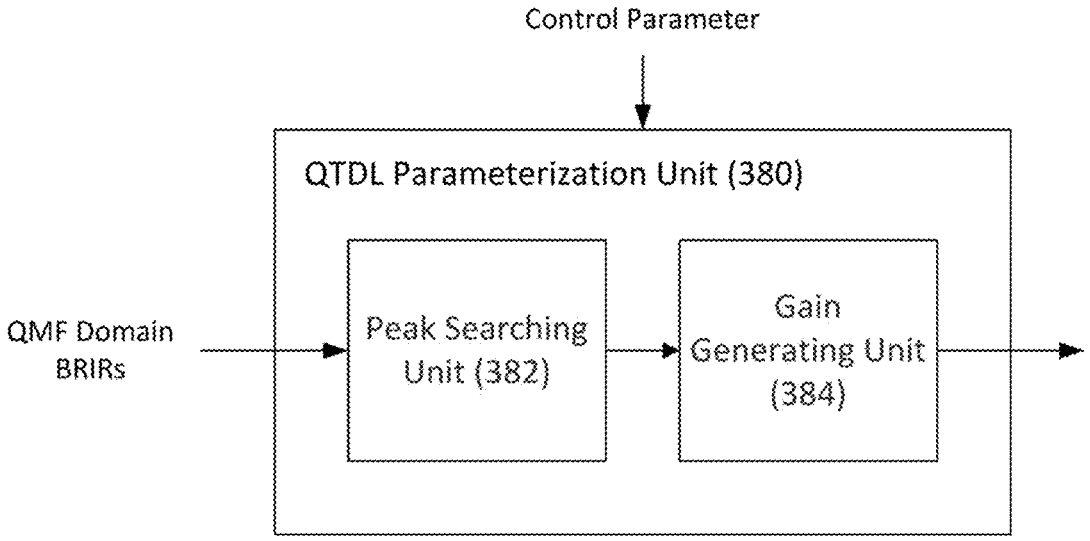
FIG. 19 is a block diagram illustrating respective components of a QTDL parameterization unit of an embodiment of the present invention.

FIG. 19 is a block diagram illustrating respective components of a QTDL parameterization unit of the present invention. As illustrated in FIG. 19, the QTDL parameterization unit 380 may include a peak searching unit 382 and a gain generating unit 384. The QTDL parameterization unit 380 may receive the QMF domain subband filter coefficients from the F-part parameterization unit 320. Further, the QTDL parameterization unit 380 may receive the information Kproc of the maximum frequency band for performing the binaural rendering and information Kconv of the frequency band for performing the convolution as the control parameters and generate the delay information and the gain information for each frequency band of a subband group (that is, second subband group) having Kproc and Kconv as boundaries.

According to a more detailed exemplary embodiment, when the BRIR subband filter coefficient for the input channel index m, the output left/right channel index i, the subband index k, and the QMF domain time slot index n is $h_{i,m}^k(n)$, the delay information $d_{i,m}^k$ and the gain information $g_{i,m}^k$ may be obtained as described below.

$$d_{i,m}^k = \underset{n}{\operatorname{argmax}}\left(|h_{i,m}^k(n)|^2\right) \quad \text{[Equation 11]}$$

$$g_{i,m}^k = \frac{\sqrt{\sum_{l=0}^{n_{end}} |h_{i,m}^k(l)|^2}}{|h_{i,m}^k(d_{i,m}^k)|} h_{i,m}^k(d_{i,m}^k) \quad \text{[Equation 12]}$$

Where, $n_{end}$ represents the last time slot of the corresponding subband filter coefficients.

That is, referring to Equation 11, the delay information may represent information of a time slot where the corresponding BRIR subband filter coefficient has a maximum size and this represents positional information of a maximum peak of the corresponding BRIR subband filter coefficients. Further, referring to Equation 12, the gain information may be determined as a value obtained by multiplying the total power value of the corresponding BRIR subband filter coefficients by a sign of the BRIR subband filter coefficient at the maximum peak position.

The peak searching unit 382 obtains the maximum peak position that is, the delay information in each subband filter coefficients of the second subband group based on Equation 11. Further, the gain generating unit 384 obtains the gain information for each subband filter coefficients based on Equation 12. Equation 11 and Equation 12 show an example of equations obtaining the delay information and the gain information, but a detailed form of equations for calculating each information may be variously modified.

Hereinabove, the present invention has been described through the detailed exemplary embodiments, but modification and changes of the present invention can be made by those skilled in the art without departing from the object and the scope of the present invention. That is, the exemplary embodiment of the binaural rendering for the multi-audio signals has been described in the present invention, but the present invention can be similarly applied and extended to even various multimedia signals including a video signal as well as the audio signal. Accordingly, it is analyzed that matters which can easily be analogized by those skilled in the art from the detailed description and the exemplary embodiment of the present invention are included in the claims of the present invention.

MODE FOR INVENTION

As above, related features have been described in the best mode.

INDUSTRIAL APPLICABILITY

The present invention can be applied to various forms of apparatuses for processing a multimedia signal including an apparatus for processing an audio signal and an apparatus for processing a video signal, and the like.

Furthermore, the present invention can be applied to a parameterization device for generating parameters used for the audio signal processing and the video signal processing.

What is claimed is:

1. A method for generating a set of filter coefficients for an audio signal, comprising:

obtaining a set of subband filter coefficients for each subband, wherein the set of subband filter coefficients is obtained from a set of time domain binaural room impulse response (BRIR) filter coefficients;

obtaining average reverberation time information of each subband by using a reverberation time extracted from the set of subband filter coefficients for a corresponding subband;

obtaining one or more coefficients for curve fitting the average reverberation time information;

obtaining flag information indicating whether a length of the set of time domain BRIR filter coefficients is larger than a predetermined value;

determining a filter order of each subband, wherein the filter order is determined, based at least in part on the flag information, by using the average reverberation time information or by using the coefficients for curve fitting, and wherein the filter order is determined to be variable in a frequency domain; and truncating the set of subband filter coefficients by using the filter order of a corresponding subband.

2. The method of claim 1, wherein when the flag information indicates that the length of the set of time domain BRIR filter coefficients is larger than the predetermined value, the filter order is determined based on a curve-fitted value which is obtained by using the coefficients for curve fitting.

3. The method of claim 2, wherein the curve-fitted value is a value of power of 2 having an approximated integer value as an index, and wherein the approximated integer value is obtained by performing a polynomial curve-fitting by using the coefficients for curve fitting.

4. The method of claim 1, wherein when the flag information indicates that the length of the set of time domain BRIR filter coefficients is not larger than the predetermined value, the filter order is determined based on the average reverberation time information of a corresponding subband without performing the curve fitting.

5. The method of claim 4, wherein the filter order is determined to be a value of power of 2 having a log-scaled approximated integer value of the average reverberation time information as an index.

6. The method of claim 1, wherein the filter order is determined as a smaller value between a reference truncation length of a corresponding subband and an original length of the set of subband filter coefficients, and wherein the reference truncation length of the corresponding subband is obtained by using the average reverberation time information or the coefficients for curve fitting.

7. The method of claim 6, wherein the reference truncation length is a value of power of 2.

8. The method of claim 1, wherein the filter order has a single value for each subband.

9. The method of claim 1, wherein the average reverberation time information is an average value of reverberation times of extracted respectively from a set of subband filter coefficients for each channel in the corresponding subband.

10. A parameterization device for generating a set of filter coefficients for an audio signal, the parameterization device configured to:

obtain a set of subband filter coefficients for each subband, wherein the set of subband filter coefficients is obtained from a set of time domain binaural room impulse response (BRIR) filter coefficients;

obtain average reverberation time information of each subband by using a reverberation time extracted from the set of subband filter coefficients for a corresponding subband;

obtain one or more coefficients for curve fitting the average reverberation time information;

obtain flag information indicating whether a length of the set of time domain BRIR filter coefficients is larger than a predetermined value;

determine a filter order of each subband, wherein the filter order is determined, based at least in part on the flag information, by using the average reverberation time information or by using the coefficients for curve fitting, and wherein the filter order is determined to be variable in a frequency domain; and truncate the set of subband filter coefficients by using the filter order of a corresponding subband.

11. The parameterization device of claim 10, wherein when the flag information indicates that the length of the set of time domain BRIR filter coefficients is larger than the predetermined value, the filter order is determined based on a curve-fitted value which is obtained by using the coefficients for curve fitting.

12. The parameterization device of claim 11, wherein the curve-fitted value is a value of power of 2 having an approximated integer value as an index, and wherein the approximated integer value is obtained by performing a polynomial curve-fitting by using the coefficients for curve fitting.

13. The parameterization device of claim 10, wherein when the flag information indicates that the length of the set of time domain BRIR filter coefficients is not larger than the predetermined value, the filter order is determined based on the average reverberation time information of a corresponding subband without performing the curve fitting.

14. The parameterization device of claim 13, wherein the filter order is determined to be a value of power of 2 having a log-scaled approximated integer value of the average reverberation time information as an index.

15. The parameterization device of claim 10, wherein the filter order is determined as a smaller value between a reference truncation length of a corresponding subband and an original length of the set of subband filter coefficients, and wherein the reference truncation length of the corresponding subband is obtained by using the average reverberation time information or the coefficients for curve fitting.

16. The parameterization device of claim 15, wherein the reference truncation length is a value of power of 2.

17. The parameterization device of claim 10, wherein the filter order has a single value for each subband.

18. The parameterization device of claim 10, wherein the average reverberation time information is an average value of reverberation times extracted respectively from a set of subband filter coefficients for each channel in the corresponding subband.

* * * * *